US009670739B2

(12) United States Patent
Tosi et al.

(10) Patent No.: US 9,670,739 B2
(45) Date of Patent: Jun. 6, 2017

(54) TRANSMITTING POWER TO GAS LIFT VALVE ASSEMBLIES IN A WELLBORE

(71) Applicant: Chevron U.S.A. Inc., San Ramon, CA (US)

(72) Inventors: Luis Phillipe Costa Ferreira Tosi, Houston, TX (US); Melvin Clark Thompson, Los Alamos, NM (US); Heath Evan Lynch, Santa Fe, NM (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 14/990,284

(22) Filed: Jan. 7, 2016

(65) Prior Publication Data

US 2016/0115766 A1 Apr. 28, 2016

Related U.S. Application Data

(63) Continuation-in-part of application No. 14/110,915, filed as application No. PCT/US2013/031526 on Mar. 14, 2013, now Pat. No. 9,316,063.

(Continued)

(51) Int. Cl.

*E21B 17/00* (2006.01)
*E21B 34/06* (2006.01)

(Continued)

(52) U.S. Cl.

CPC ..... *E21B 17/003* (2013.01); *E21B 17/028* (2013.01); *E21B 43/123* (2013.01); *E21B 43/128* (2013.01); *E21B 41/0085* (2013.01)

(58) Field of Classification Search

CPC .... E21B 34/066; E21B 17/003; E21B 17/028; E21B 47/12; E21B 17/206; E21B 43/128

See application file for complete search history.

(56) References Cited

U.S. PATENT DOCUMENTS 4,981,173 A 1/1991 Perkins
4,987,684 A 1/1991 Andreas et al.

(Continued)

FOREIGN PATENT DOCUMENTS

EP 0721053 7/1996
GB 2330598 4/1999

(Continued)

OTHER PUBLICATIONS

International Search Report, mailed Dec. 18, 2014 for PCT/US2014/056385.

*Primary Examiner* — Daniel P Stephenson
(74) *Attorney, Agent, or Firm* — King & Spalding LLP

(57) ABSTRACT

A gas lift valve system for a wellbore within a subterranean formation can include a power source that generates power, and a delivery system disposed within the wellbore and electrically coupled to the power source, where the delivery system delivers the power generated by the power source. The system can also include at least one gas lift valve assembly disposed within the wellbore and electrically coupled to the delivery system, where the at least one gas lift valve assembly receives the power from the delivery system, where at least one valve, when in a position other than a fully closed position, allows a control medium to flow from an inlet channel to an outlet channel, where the outlet channel empties into the cavity of the delivery system.

17 Claims, 10 Drawing Sheets

Related U.S. Application Data

(60) Provisional application No. 61/731,332, filed on Nov. 29, 2012.

(51) Int. Cl.

| | |
|---|---|
| ***E21B 43/12*** | (2006.01) |
| ***E21B 17/02*** | (2006.01) |
| *E21B 41/00* | (2006.01) |

(56) References Cited

U.S. PATENT DOCUMENTS

| | | | | |
|---|---|---|---|---|
| 5,176,164 | A * | 1/1993 | Boyle | E21B 34/06 137/155 |
| 5,745,047 | A * | 4/1998 | Van Gisbergen | E21B 17/003 340/853.1 |
| 6,070,608 | A * | 6/2000 | Pringle | E21B 34/066 137/155 |
| 6,098,727 | A | 8/2000 | Ringgenberg et al. | |
| 6,515,592 | B1 | 2/2003 | Babour et al. | |
| 6,633,236 | B2 * | 10/2003 | Vinegar | E21B 43/122 166/73 |
| 7,882,892 | B2 * | 2/2011 | Svenning | 166/65.1 |
| 8,575,936 | B2 * | 11/2013 | Bloys | E21B 47/06 324/338 |
| 8,857,522 | B2 * | 10/2014 | Arrazola | E21B 34/10 166/363 |
| 9,103,198 | B2 * | 8/2015 | Gonzalez | E21B 47/122 |
| 9,316,063 | B2 * | 4/2016 | Gonzalez | E21B 17/003 |
| 2002/0126021 | A1 * | 9/2002 | Vinegar | E21B 43/122 340/854.3 |
| 2003/0047317 | A1 | 3/2003 | Powers | |
| 2003/0227393 | A1 | 12/2003 | Vinegar et al. | |
| 2004/0104047 | A1 | 6/2004 | Peter | |
| 2005/0051334 | A1 | 3/2005 | Baugh | |
| 2009/0050374 | A1 | 2/2009 | Spiecker et al. | |
| 2009/0159361 | A1 * | 6/2009 | Coates | G01V 11/00 181/106 |
| 2009/0174409 | A1 * | 7/2009 | Coates | E21B 47/122 324/338 |
| 2011/0037004 | A1 | 2/2011 | Lake | |
| 2011/0186303 | A1 * | 8/2011 | Scott | E21B 34/066 166/373 |
| 2011/0232921 | A1 | 9/2011 | Hopmann et al. | |
| 2011/0309949 | A1 | 12/2011 | Dopf et al. | |
| 2015/0252625 | A1 * | 9/2015 | Gonzalez | E21B 43/128 166/65.1 |
| 2016/0115766 | A1 * | 4/2016 | Tosi | E21B 43/128 166/373 |

FOREIGN PATENT DOCUMENTS

| | | | | |
|---|---|---|---|---|
| GB | 2461065 | | 12/2009 | |
| WO | WO 80/00727 | | 4/1980 | |
| WO | WO 8202754 | A1 * | 8/1982 | E21B 17/003 |
| WO | WO 01/65061 | | 9/2001 | |

* cited by examiner

TRANSMITTING POWER TO GAS LIFT VALVE ASSEMBLIES IN A WELLBORE

CROSS-REFERENCE TO RELATED APPLICATION

This application is a continuation-in-part application and claims priority to U.S. patent application Ser. No. 14/110,915, titled "Transmitting Power Within a Wellbore" and filed on Oct. 9, 2013, which is a national phase application of and claims priority to PCT Patent Application No. PCT/US2013/31526, titled "Transmitting Power Within A Wellbore" and filed on Mar. 14, 2013, which claims priority under 35 U.S.C. §119 to U.S. Provisional Patent Application Ser. No. 61/731,332, titled "Method, System and Apparatus for Transmitting Power into a Wellbore" and filed on Nov. 29, 2012. The entire contents of the foregoing applications are hereby incorporated herein by reference.

The present application is also related to U.S. patent application Ser. No. 13/295,784, titled "System and Method for Remote Sensing," and filed on Nov. 14, 2011, which claims priority to U.S. Provisional Patent Application Ser. No. 61/413,179, titled "System and Method for Remote Sensing," and filed on Nov. 12, 2010. The entire contents of the foregoing applications are hereby incorporated herein by reference.

TECHNICAL FIELD

The present disclosure relates generally to the application of electrical power into a subterranean wellbore, and more specifically to the operation of gas lift valves using electrical power.

BACKGROUND

In the production of oil and gas from a wellbore, it is sometimes necessary to employ pumps or other apparatus deep within the well for the purpose of pumping downhole fluids such as oil and gas vertically upwards for production from the wellbore. Similarly, a set of valves may be employed within the wellbore construction to control the influx of a less-dense fluid into the wellbore to alleviate the hydrostatic pressure of wellbore fluids on the production. Such pumps and valves use electrical power to operate.

Subterranean wellbores may be drilled and constructed several miles below the ground or seabed. It is difficult or inconvenient to deliver electrical power to downhole equipment in such harsh environments. In some cases, electrical cables are installed in the wellbore, but such cables sometimes are difficult and expensive to install and maintain in an operationally secure manner. In addition, it can be difficult to install a cable in the confined space of a well for distances of several thousand feet, from the surface to downhole power consuming devices. Additionally, such cables may become eroded or damaged during installation or during use. Such damage may require costly workovers and delays in oil and gas production.

SUMMARY

In general, in one aspect, the disclosure relates to a system for applying power into a wellbore within a subterranean formation. The system can include a casing disposed within the wellbore and having a number of electrically conductive casing pipes mechanically coupled end-to-end, where the casing has a first cavity running therethrough. The system can also include a tubing string having a number of electrically conductive tubing pipes mechanically coupled end-to-end, where the tubing string is disposed within the first cavity without contacting the casing, where the tubing string has a top neutral section positioned proximate to an entry point of the wellbore, a bottom neutral section positioned toward a distal end of the wellbore, and a power-transmitting section positioned between the top neutral section and the bottom neutral section, and where the tubing string has a second cavity running therethrough. The system can further include a first isolator sub mechanically coupled to and positioned between the neutral section and the power-transmitting section of the tubing string, where the first isolator sub has the second cavity running therethrough, and where the first isolator sub electrically separates the casing from the tubing string and the top neutral section from the power-transmitting section. The system can also include a power source positioned above the entry point and electrically coupled to a top end of the power-transmitting section of the tubing string below the first isolator sub, where the power source generates power comprising at least 1 VA. The system can further include a second isolator sub mechanically coupled to the tubing string and positioned between the bottom neutral section and the power-transmitting section of the tubing string, where the second isolator sub has the second cavity running therethrough, and where the second isolator sub electrically separates the casing from the tubing string and the bottom neutral section from the power-transmitting section. The system can also include an electrical device disposed within the wellbore below the second isolator sub and electrically coupled to a bottom end of the power-transmitting section of the tubing string.

In another aspect, the disclosure can generally relate to an isolator sub disposed between casing walls in a wellbore of a subterranean formation. The isolator sub can include an outer case having an electrically conductive material, a first aperture that traverses a top end of the outer case, and a second aperture that traverses a bottom end of the outer case. The isolator sub can also include an inner wall disposed within the outer case and forming a cavity therethrough, where the cavity is bounded by the first aperture and the second aperture, where the inner wall is mechanically coupled to a neutral portion of a tubing string at the top end and to a power-transmitting portion of the tubing string at the bottom end. The isolator sub can further include an insulating material disposed between the outer case and the inner wall, where the insulating material is electrically nonconductive, is impervious to fluids and gases, and can withstand temperatures in excess of 600° F. The insulating material can surround a portion of the power-transmitting portion of the tubing string. The power-transmitting portion of the tubing string can be electrically coupled to a power source and can be disposed between the casing walls in the wellbore.

In yet another aspect, the disclosure can generally relate to an isolator sub disposed between casing walls in a wellbore of a subterranean formation. The isolator sub can include an outer case having an electrically conductive material, a first aperture that traverses a bottom end of the outer case, and a second aperture that traverses a top end of the outer case. The isolator sub can also include an inner wall disposed within the outer case and forming a cavity therethrough, where the cavity is bounded by the first aperture and the second aperture, where the inner wall is mechanically coupled to a neutral portion of a tubing string at the bottom end and to a power-transmitting portion of the tubing string at the top end. The isolator sub can further include an insulating material disposed between the outer case and the inner wall, where the insulating material is electrically nonconductive, is impervious to fluids and gases, and can withstand temperatures in excess of 600° F. The insulating material can surround a portion of the power-transmitting portion of the tubing string. The power-transmitting portion of the tubing string can be electrically coupled to a power source and can be disposed between the casing walls in the wellbore.

These and other aspects, objects, features, and embodiments will be apparent from the following description and the appended claims.

BRIEF DESCRIPTION OF THE DRAWINGS

The drawings illustrate only example embodiments of methods, systems, and devices for transmitting power within a wellbore (also called herein a "borehole") and are therefore not to be considered limiting of its scope, as transmitting power within a wellbore may admit to other equally effective embodiments. This is similarly applied to drawings illustrating any valve and the mechanical and electrical valve-wellbore coupling hardware. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
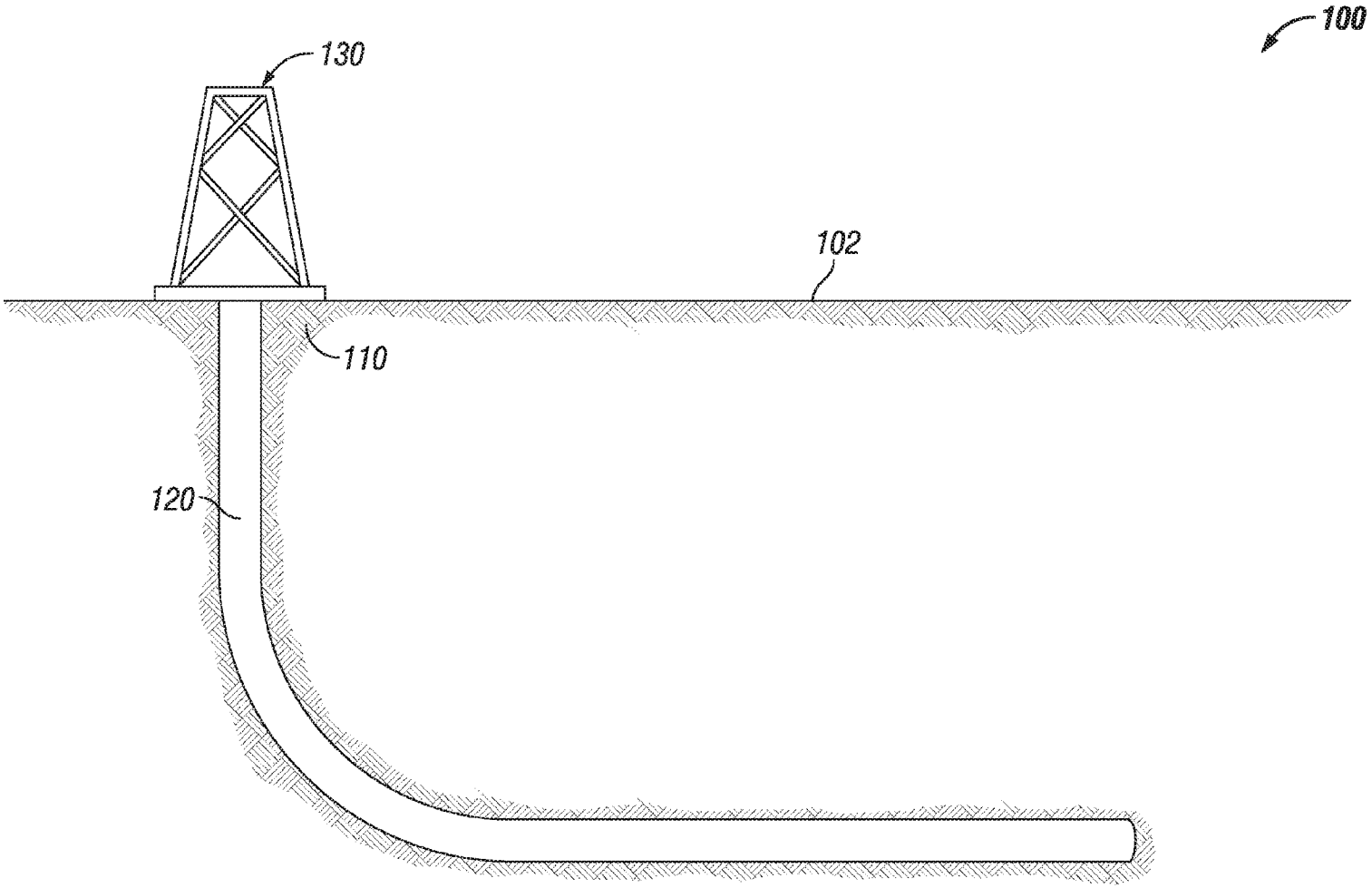
FIG. 1 shows a schematic diagram of a field system that can transmit power within a subterranean wellbore in accordance with certain example embodiments.

Example embodiments directed to transmitting power within a subterranean wellbore will now be described in detail with reference to the accompanying figures. Like, but not necessarily the same or identical, elements in the various figures are denoted by like reference numerals for consistency. In the following detailed description of the example embodiments, numerous specific details are set forth in order to provide a more thorough understanding of the disclosure herein. However, it will be apparent to one of ordinary skill in the art that the example embodiments herein may be practiced without these specific details. In other instances, well-known features have not been described in detail to avoid unnecessarily complicating the description. As used herein, a length, a width, and a height can each generally be described as lateral directions.

In certain embodiments, it is necessary to consider the balance of voltage versus current for a given power requirement within the wellbore. A higher voltage and lower current density may be required. High voltage may impact the insulation systems, while high current may impact resistive losses, causing undesirable electric etching and heating in the interfaces or conductors. In some example embodiments, a significant effort can be made to operate the system voltage as high as possible to reduce the system current to a level that is as low as possible. High system current may result in a voltage gradient from wellhead to casing end on the outer surface of the casing, which is undesirable. However, it is recognized that many different voltage, amperage, and power requirements could be used with example embodiments, and that example embodiments are not limited to any particular voltage, amperage, or power values.

The case for higher system voltage (i.e., lower current) has advantages in certain example embodiments. An isolator sub (described below) is an insulating short joint section, one of which can be located near the wellhead, that allows a break in metallic or conductor connection between its two ends. This allows the string tubing below the isolator sub to be electrically insulated from the string tubing above the isolator sub. If another isolator sub is placed at the bottom of the tubing string in the wellbore, a portion of tubing string (the power-transmitting section of the tubing string, as defined below in FIG. 2) can be excited electrically to carry current to an electrical device (i.e., a pump, a motor) positioned within the wellbore. Example embodiments described herein provide not only inductive isolation of the voltage-transmitting section of the tubing string, but also dielectric isolation. Thus, systems using example embodiments can deliver higher voltages and/or currents to an electrical device within a wellbore.

A user as described herein may be any person that is involved with a piping system in a subterranean wellbore and/or transmitting power within the subterranean wellbore for a field system. Examples of a user may include, but are not limited to, a roughneck, a company representative, a drilling engineer, a tool pusher, a service hand, a field engineer, an electrician, a mechanic, an operator, a consultant, a contractor, and a manufacturer's representative.

FIG. 1 shows a schematic diagram of a field system 100 that can transmit power within a subterranean wellbore in accordance with one or more example embodiments. In one or more embodiments, one or more of the features shown in FIG. 1 may be omitted, added, repeated, and/or substituted. Accordingly, embodiments of a field system should not be considered limited to the specific arrangements of components shown in FIG. 1.

Referring now to FIG. 1, the field system 100 in this example includes a wellbore 120 that is formed in a subterranean formation 110 using field equipment 130 above a surface 102, such as ground level for an on-shore application and the sea floor for an off-shore application. The point where the wellbore 120 begins at the surface 102 can be called the entry point. The subterranean formation 110 can include one or more of a number of formation types, including but not limited to shale, limestone, sandstone, clay, sand, and salt. In certain embodiments, a subterranean formation 110 can also include one or more reservoirs in which one or more resources (e.g., oil, gas, water, steam) can be located. One or more of a number of field operations (e.g., drilling, setting casing, extracting downhole resources) can be performed to reach an objective of a user with respect to the subterranean formation 110.

The wellbore 120 can have one or more of a number of segments, where each segment can have one or more of a number of dimensions. Examples of such dimensions can include, but are not limited to, size (e.g., diameter) of the wellbore 120, a curvature of the wellbore 120, a total vertical depth of the wellbore 120, a measured depth of the wellbore 120, and a horizontal displacement of the wellbore 120. The field equipment 130 can be used to create and/or develop (e.g., extract downhole materials) the wellbore 120. The field equipment 130 can be positioned and/or assembled at the surface 102. The field equipment 130 can include, but is not limited to, a derrick, a tool pusher, a clamp, a tong, drill pipe, a drill bit, example isolator subs, tubing pipe, a power source, and casing pipe. The field equipment 130 can also include one or more devices that measure and/or control various aspects (e.g., direction of wellbore 120, pressure, temperature) of a field operation associated with the wellbore 120. For example, the field equipment 130 can include a wireline tool that is run through the wellbore 120 to provide detailed information (e.g., curvature, azimuth, inclination) throughout the wellbore 120. Such information can be used for one or more of a number of purposes. For example, such information can dictate the size (e.g., outer diameter) of a casing pipe to be inserted at a certain depth in the wellbore 120.

Figure 2:
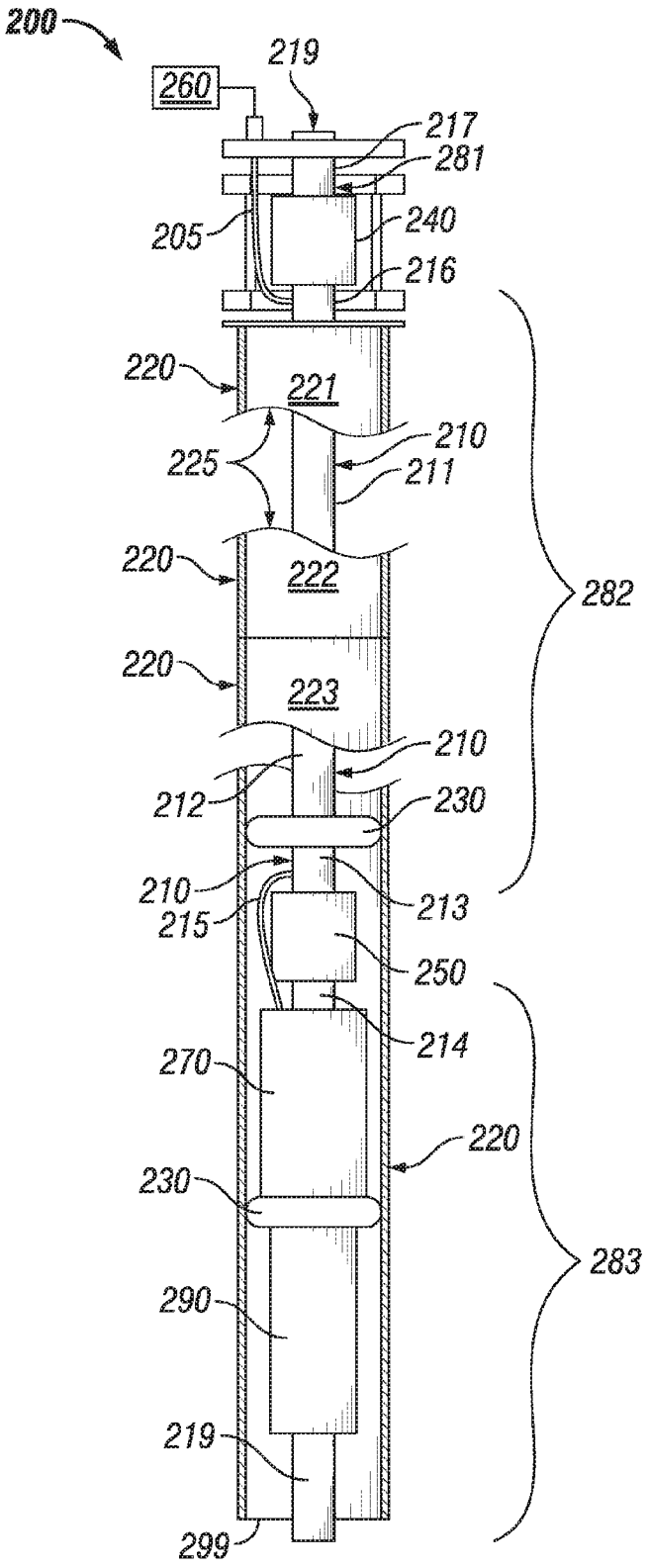
FIG. 2 shows a side view in partial cross section of a piping system within a wellbore of a field system in accordance with certain example embodiments.

FIG. 2 shows a side view in partial cross section of a piping system 200 within a wellbore of a field system in accordance with certain example embodiments. In one or more embodiments, one or more of the features shown in FIG. 2 may be omitted, added, repeated, and/or substituted. Accordingly, embodiments of a piping system should not be considered limited to the specific arrangements of components shown in FIG. 2.

The piping system 200 comprises a casing 220, a tubing string 210, a power source 260, a top isolator sub 240, a bottom isolator sub 250, a power conditioner 270, an electrical device 290, and a number of centralizers 230, and a conductive interface 299. Referring to FIGS. 1 and 2, the casing 220 includes a number of casing pipes (e.g., casing pipe 221, casing pipe 222, casing pipe 223) that are mechanically coupled to each other end-to-end, usually with mating threads. The casing pipes of the casing 220 can be mechanically coupled to each other directly or using a coupling device, such as a coupling sleeve.

Each casing pipe of the casing 220 can have a length and a width (e.g., outer diameter). The length of a casing pipe can vary. For example, a common length of a casing pipe is approximately 40 feet. The length of a casing pipe can be longer (e.g., 60 feet) or shorter (e.g., 10 feet) than 40 feet. The width of a casing pipe can also vary and can depend on the cross-sectional shape of the casing pipe. For example, when the cross-sectional shape of the casing pipe is circular, the width can refer to an outer diameter, an inner diameter, or some other form of measurement of the casing pipe. Examples of a width in terms of an outer diameter can include, but are not limited to, 7 inches, 7⅝ inches, 8⅝ inches, 10¾ inches, 13⅜ inches, and 14 inches.

The size (e.g., width, length) of the casing 220 is determined based on the information gathered using field equipment 130 with respect to the wellbore 120. The walls of the casing 220 have an inner surface that forms a cavity 225 that traverses the length of the casing 220. The casing 220 can be made of one or more of a number of suitable materials, including but not limited to steel. In certain example embodiments, the casing 220 is made of an electrically conductive material. The casing 220 can have, at least along an inner surface, a coating of one or more of a number of electrically non-conductive materials. The thickness of such a coating can vary, depending on one or more of a number of factors, such as the imbalance in current density between the tubing string 210 and the casing 220 that must be overcome to maintain the electric circuit.

The tubing string 210 includes a number of tubing pipes (e.g., tubing pipe 211, tubing pipe 212, tubing pipe 213, tubing pipe 214, tubing pipe 219, tubing pipe 216, tubing pipe 217) that are mechanically coupled to each other end-to-end, usually with mating threads. The tubing pipes of the tubing string 210 can be mechanically coupled to each other directly or using a coupling device, such as a coupling sleeve or an example isolator sub (e.g., top isolator sub 240, bottom isolator sub 250), described below. In some cases, more than one tubing string can be disposed within a cavity 225 of the casing 220.

Each tubing pipe of the tubing string 210 can have a length and a width (e.g., outer diameter). The length of a tubing pipe can vary. For example, a common length of a tubing pipe is approximately 30 feet. The length of a tubing pipe can be longer (e.g., 40 feet) or shorter (e.g., 10 feet) than 30 feet. The width of a tubing pipe can also vary and can depend on one or more of a number of factors, including but not limited to the inner diameter of the casing pipe. For example, the width of the tubing pipe is less than the inner diameter of the casing pipe. The width of a tubing pipe can refer to an outer diameter, an inner diameter, or some other form of measurement of the tubing pipe. Examples of a width in terms of an outer diameter can include, but are not limited to, 7 inches, 5 inches, and 4 inches.

Two tubing pipes (e.g., tubing pipe 216 and tubing pipe 217, tubing pipe 213 and tubing pipe 214) of the tubing string 210 can be mechanically coupled to each other using an isolator sub (e.g., top isolator sub 240, bottom isolator sub 250, respectively). In such a case, the tubing string 210 can be divided into segments. For example, as shown in FIG. 2, the portion (e.g., tubing pipe 217) of the tubing string 210 located above the top isolator sub 240 can be called the top neutral section 281, and the portion (e.g., tubing pipe 214, tubing pipe 219) of the tubing string 210 located below the bottom isolator sub 250 can be called the bottom neutral section 283. As another example, the portion (e.g., tubing pipe 211, tubing pipe 212, tubing pipe 213) of the tubing string 210 located between the top isolator sub 240 and the bottom isolator sub 250 can be called the power-transmitting section 282.

The size (e.g., outer diameter, length) of the tubing string 210 is determined based, in part, on the size of the cavity 225 within the casing 220. The walls of the tubing string 210 have an inner surface that forms a cavity 219 that traverses the length of the tubing string 210. The tubing string 210 can be made of one or more of a number of suitable materials, including but not limited to steel. The one or more materials of the tubing string 210 can be the same or different than the materials of the casing 220. In certain example embodiments, the tubing string 210 is made of an electrically conductive material. However, the tubing string 210 should not "electrically" contact the casing 220, so that the circuit is maintained. The tubing string 210 can have, at least along an outer surface, a coating of one or more of a number of electrically non-conductive materials. In such a case, the coating of an electrically insulating material can be thick and rugged so as to complete the 'insulation' system for the necessary voltage requirement of a given application.

The power source 260 can be any device (e.g., generator, battery) capable of generating electric power that can be used to operate the electrical device 290, described below. In certain example embodiments, the power source 260 is electrically coupled to the tubing string 210. Specifically, the power source 260 can be coupled to a portion of the power-transmitting section 282 of the tubing string. The power source 260 can be electrically coupled to the tubing string 210 wirelessly and/or using one or more electrical conductors (e.g., a cable). For example, as shown in FIG. 2, cable 205 can be used to electrically couple the power source 260 to the top end of the power-transmitting section 282 of the tubing string 210. In certain example embodiments, cable 205 is capable of maintaining a high current density connection between the power source 260 and the power-transmitting section 282 of the tubing string 210. In certain example embodiments, high current densities are needed when higher voltages cannot be accommodated safely or reliably.

As an example, in 10,000 foot wellbore 120, the total string (tubing string 210 and casing 220) resistance can be approximately 3 Ohms. If the current that is required by the electrical device 290 is 100 amperes, then the power source 260 must provide 300 volts (100 Aλ 3Ω=300 V) above that used by the electrical device 290. The reason that an extra 300 V is needed is because the 300 V is lost to the tubing string 210 and the casing 220, and so the electrical device 290 does not receive the 300 V. In view of these losses caused by the tubing string 210 and the casing 220, an electrical device 290 using a high (e.g., 1000 A) amount of amperage may be beyond a practical application as the voltage loss (e.g., 3000V) through the tubing string 210 and the casing 220 may exceed practical electrical and/or hardware configurations.

The power generated by the power source 260 can be alternating current (AC) power or direct current (DC) power. If the power generated by the power source 260 is AC power, the power can be delivered in one phase. The power generated by the power source 260 can be conditioned (e.g., transformed, inverted, converted) by a power conditioner (not shown in FIG. 2, but similar to the power conditioner 270 described below) before being delivered to the tubing string 210. In certain example embodiments, one pole (e.g., the "hot" leg of a single phase AC current) of the power generated by the power source 260 can be electrically coupled to the tubing string 210, while another pole (e.g., the neutral leg of a single phase AC current) can be electrically coupled to the casing 220. In such a case, a complete circuit can be created between the tubing string 210 and the casing 220, using other components of the piping system 200 described below.

In certain example embodiments, the top isolator sub 240 is positioned between, and mechanically coupled to, the top neutral section 281 of the tubing string 210 and the power-transmitting section 282 of the tubing string 210. In such a case, the top isolator sub 240 electrically isolates (or electrically separates) the top neutral section 281 of the tubing string 210 from the power-transmitting section 282 of the tubing string 210. In addition, the top isolator sub 240 can electrically isolate the casing 220 from the tubing string 210. An amount of voltage and/or current generated by the power source 260 (described below) can, in part, determine the size and/or features of the top isolation sub 240 that is used for a given application.

In certain example embodiments, the top isolator sub 240 has a cavity that traverses therethrough. In such a case, the cavity of the top isolator sub 240 can be substantially the same size as the cavity 219 of the tubing string 210. Thus, when the top isolator sub 240 is positioned between and mechanically coupled to the top neutral section 281 of the tubing string 210 and the power-transmitting section 282 of the tubing string 210, a continuous passage traverses therethrough. Details of the top isolator sub 240 are described below with respect to FIGS. 3 and 5A-5C.

Similarly, in certain example embodiments, the bottom isolator sub 250 is positioned between, and mechanically coupled to, the bottom neutral section 283 of the tubing string 210 and the power-transmitting section 282 of the tubing string 210. In such a case, the bottom isolator sub 250 electrically isolates the bottom neutral section 283 of the tubing string 210 from the power-transmitting section 282 of the tubing string 210. In addition, the bottom isolator sub 250 can electrically isolate the casing 220 from the tubing string 210. An amount of voltage and/or current generated by the power source 260 (described below) can, in part, determine the size and/or features of the bottom isolation sub 250 that is used for a given application. Other factors that can affect the size and/or features of the bottom isolation sub 250 can include, but are not limited to, the length of the power-transmitting section 282, the size (e.g., inner diameter, outer diameter) of the tubing string 210, and the material of the tubing string 210.

As with the top isolator sub 240, the bottom isolator sub 250 has a cavity that traverses therethrough. In such a case, the cavity of the bottom isolator sub 250 can be substantially the same size as the cavity 219 of the tubing string 210. Thus, when the bottom isolator sub 250 is positioned between and mechanically coupled to the bottom neutral section 283 of the tubing string 210 and the power-transmitting section 282 of the tubing string 210, a continuous passage traverses therethrough. Electrically, in certain example embodiments, an isolator sub (e.g., top isolator sub 240, bottom isolator sub 250) behaves like a dielectric break in an otherwise solid piece of the power-transmission section of the tubing string 210. In actual practice, such an isolator sub fits within the cavity 225 of the casing 220 with sufficient clearance from the walls of the casing 220, exhibits low end-to-end capacitance, and is able to standoff many hundreds of volts of applied potential.

In accordance with example embodiments, a technique for electrical isolation includes a ceramic and/or other electrically non-conductive insulator inserted in series with tubing pipes of the tubing string 210. This may be, for example, built-in to a section of pipe that is relatively short (e.g., 4 foot section) relative to the length of a tubing pipe. The word "sub" for the isolator subs described herein is used to designate that the length of an isolator sub, having such electrically non-conductive properties, can be of relatively short length. The ceramic and portions of the tubing string 210 may be clamped together and can be connected without creating an electrical short in the tubing string 210. An insulating coating may be applied to the internal and external surfaces of the tubing string 210 and/or the shell of the isolator sub as electrical breakdown protection across the gap between the tubing string 210 and the shell of the isolator sub.

In an example, a field test of an isolation sub called a "Gapsub" was conducted where approximately 300 $V_{rms}$ and 75 A was applied to the tubing string 210. In this case, the piping system 200 could support an electrical device 290 (described below) with a 15 horsepower (HP) rating at a depth within the wellbore 120 of approximately 1000 feet. In this example, approximately 350 $V_{rms}$ was generated by the power source 260 and delivered to the tubing string 210 so that approximately 300 $V_{rms}$ was delivered to the electrical device 290. The electrical device 290 in this case was a pump, and the pump, receiving power using an example embodiment, delivered field resources from the subterranean formation 110. Field applications at greater depths (e.g., 10,000 feet) using example embodiments can require higher voltages (e.g., 1200 $V_{rms}$, 2500 $V_{rms}$) generated by the power source 260.

An isolator sub (e.g., top isolator sub 240, bottom isolator sub 250) is capable of withstanding one or more of a number of environmental conditions in the wellbore 120. In addition to supporting the weight of the remainder of the downhole portion of the piping system 200 (which is a critical aspect of the top isolator sub 240 because the top isolator sub 240 is positioned at the top end of the tubing string 210), as described above, an isolator sub can resist torque, torsion, bending, and/or any other force that could impact the mechanical integrity of the isolator sub. These latter characteristics are important for the bottom isolator sub 250, which is mechanically coupled to the bottom neutral section 283 of the tubing string 210 and then gradually inserted further into the wellbore 120 as the various tubing pipes of the power-transmitting section 282 of the tubing string 210 is made up (mechanically coupled to each other, commonly using mating threads and thus a rotational motion).

The isolator sub can also be equipped (for example, with a number of sealing members, as described below with respect to FIGS. 5A-5C) to be impervious to fluids and/or gases within the cavity 225 of the casing 220. Such fluids and gases are one or more of a number of fluids and gases found within the wellbore 120 of the subterranean formation 110. Further, the isolator sub can withstand temperatures in excess of 600° F. or 750° F. For example, within a wellbore, it is not uncommon to encounter steam in excess of 600° F., and so each isolator sub can be able to sustain operation and mechanical integrity while being exposed to such temperatures.

The optional power conditioner 270 can be disposed within the cavity 225 of the casing 220 proximate to the bottom isolator sub 250. For example, as shown in FIG. 2, the power conditioner 270 can be located below the bottom isolator sub 250. The power conditioner 270 can also be disposed outside of and/or integral with the tubing string 210. In such a case, the power conditioner 270 can have a feature substantially similar to the top isolator sub 240 and the bottom isolator sub 250 in that the power conditioner 270 can have a cavity that traverses therethrough. In such a case, the cavity of the power conditioner 270 can be substantially the same size as the cavity 219 of the tubing string 210. Thus, when the power conditioner 270 is positioned between and mechanically coupled to portions (e.g., tubing pipe 214, tubing pipe 219) of the bottom neutral section 283 of the tubing string 210, a continuous passage traverses therethrough.

In certain example embodiments, the power conditioner 270 is electrically coupled to the tubing string 210. Specifically, the power conditioner 270 can be coupled to a portion of the power-transmitting section 282 of the tubing string 210. The power conditioner 270 can be electrically coupled to the tubing string 210, for example, using one or more electrical conductors (e.g., a cable). For example, as shown in FIG. 2, cable 215 can be used to electrically couple the power conditioner 270 to the bottom end of the power-transmitting section 282 of the tubing string 210. In certain example embodiments, cable 215 is capable of maintaining a high current connection between the power conditioner 270 and the power-transmitting section 282 of the tubing string 210.

The power received by the power conditioner 270 can be the same type of power (e.g., AC power, DC power) generated by the power source 260. The power received by the power conditioner 270 can be conditioned (e.g., transformed, inverted, converted) into any level and/or form required by the electrical device 290 before being delivered to the electrical device 290. For example, if the power conditioner 270 receives single phase AC power, the power conditioner 270 can generate 120V three phase AC power, which is sent to the electrical device 290. As described herein the power conditioned by the power conditioner 270 can be called conditioned power.

The electrical device 290 is electrically coupled to the power conditioner 270 or, if there is no power conditioner 270, to the power-transmitting section 282 of the tubing string 210. The electrical device 290 uses electric power (conditioned by the power conditioner 270) to operate and perform one or more functions within the wellbore 120. Examples of the electrical device 290 can include, but are not limited to, a motorized valve, a boiler, and a pump. For example, the electrical device 290 can be a pump assembly (e.g., pump, pump motor) that can pump, when operating, oil, gas, and/or production fluids from the wellbore 120 to the surface 102. The electrical device 290 can include a control system that controls the functionality of the electrical device 290. Such a control system can be communicably coupled with a user and/or some other system so that the control system can receive and/or send commands and/or data.

In certain example embodiments, a conductive interface 299 is disposed below the bottom isolator sub 250 within the cavity of the casing 220. The conductive interface 299 can be electrically coupled to the electrical device 290. In such a case, the conductive interface 299 electrically couples the casing 220 to the tubing string 210. Thus, the casing 220 can be used as a return leg to complete the electric circuit that starts at the power source 260. The conductive interface 299 can be made of one or more of a number of electrically conductive materials. The conductive interface 299 can be a packer, a seal, an anchor assembly, or any other suitable device that can be placed within the wellbore 120.

A conventional interface at the conductive interface 299 may employ a design that ensures conductivity for the circuit. In certain example embodiments, the conductive interface 299 includes metallic (or otherwise electrically conductive) "teeth" that expand out to the casing 220 to anchor and seal the production area within the cavity 225. The anchoring or locating 'teeth' can establish the electrical current path, and special robust designs can be used in the practice of this invention.

Centralizing the tubing string 210 within the cavity 225 of the casing 210 may be a mechanical and/or electrical requirement for the operational use of example embodiments. A number of centralizers 230 can be disposed at various locations throughout the cavity 225 of the casing 220 between the casing 220 and the tubing string 210. In certain example embodiments, each centralizer 230 contacts both the outer surface of the tubing string 210 and the inner surface of the casing 220. Each centralizer 230 can have robust electrical insulation to prevent arc paths between the tubing string 210 and the casing 220.

Each centralizer 230 can be the same and/or different from the other centralizers 230 in the piping system 200. A centralizer 230 can be made of and/or coated with one or more of a number of electrically non-conductive materials. Thus, each centralizer 230 can provide an electrical separation between the tubing string 210 and the casing 220. In certain example embodiments, the centralizer 230 can provide a physical barrier within the cavity 225 of the casing 220 between the casing 220 and the tubing string 210.

Thus, the electrical circuit formed by the power source 260, the power-transmitting section 282 of the tubing string 210, the power conditioner 270, the electrical device 290, the conductive interface 299, and the casing 220 is not altered by arcing that can result between the tubing string 210 and the casing 220. A centralizer 230 design that, over time, would have a minimized surface for collection of surface debris (e.g., dirt) also may be useful for long life of the piping system 200. A surface of a centralizer 230 with undesirable dirt collection could provide a path for undesirable voltage breakdown and inoperability of the piping system 200.

High voltage breakdown is typically a short term event (i.e. short term to failure). Long term (i.e. months or years) exposure of conducting systems to high currents may impact all interfaces across which current passes, including welded and threaded joints. Shoe and slip contact from an anchor/packer to the wall of the casing needs to be robust to preserve the desired electrical pathway and electrical conductivity.

Figure 3:
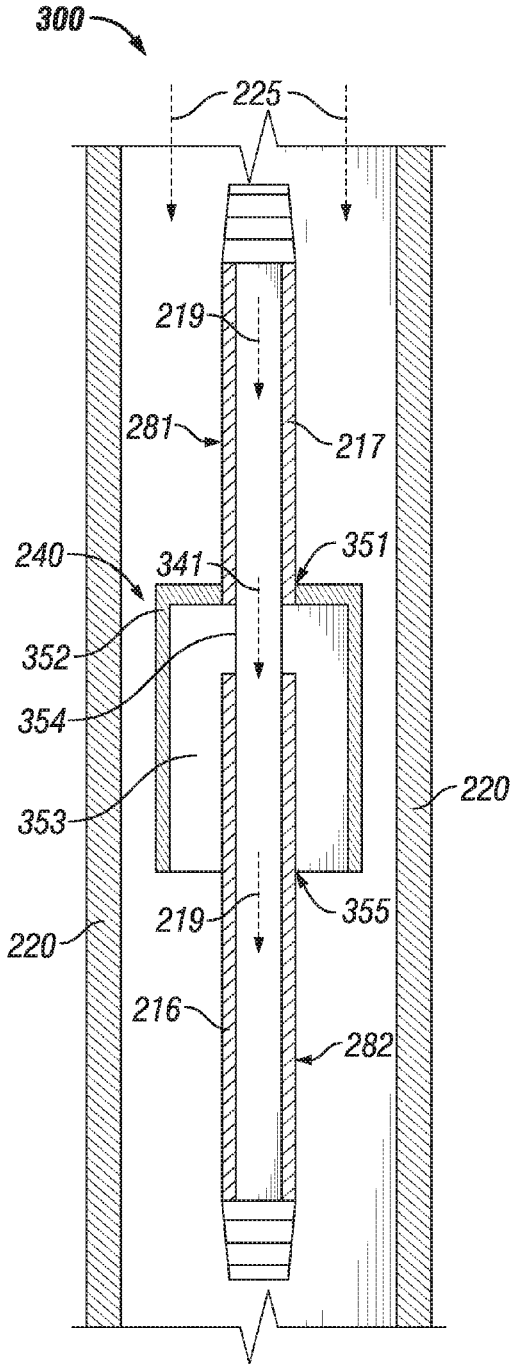
FIG. 3 shows a cross-sectional side view of a portion of a piping system in accordance with certain example embodiments.

FIG. 3 shows a cross-sectional side view of a portion 300 of the piping system 200 of FIG. 2 in accordance with certain example embodiments. Specifically, referring to FIGS. 1-3, FIG. 3 shows the bottom portion of the top neutral section 281 of the tubing string 210, the top isolator sub 240, and the top portion of the power-transmitting section 282 of the tubing string 210 of the piping system 200 of FIG. 2.

The cross-sectional view of FIG. 3 provides a detailed view of how, in certain example embodiments, the bottom portion of the top neutral section 281 of the tubing string 210 and the top portion of the power-transmitting section 282 of the tubing string 210 mechanically couple to the top isolator sub 240. In this example, the top isolator sub 240 has a shell 352 (also sometimes called a housing) that mechanically (e.g., threadably) couples to the bottom portion (in this case, tubing pipe 217) of the top neutral section 281 of the tubing string 210. In such a case, the shell 352 can have an aperture 351 through its top portion that traverses the shell 352. The shell 352 can be made of one or more of a number of materials. Such materials can be electrically conductive (e.g., steel) and/or electrically non-conductive (e.g., ceramic).

In certain example embodiments, disposed between the walls of the shell 352 is an insulator 353. The insulator 353 can be made of one or more of a number of electrically non-conductive materials (e.g., ceramic, ketone, a polymer). The insulator 353 can have an aperture 355 that originates at the bottom portion of the insulator 353 and traverses some or all of the top isolator sub 240. To avoid a fault condition, the aperture 355 is sized large enough for voltage hold-off between shell 352 and the tubing pipe 216. The aperture 355 can also have and have one or more of a number of features (e.g., mating threads) to receive and mechanically couple to the top portion (in this example, tubing pipe 216) of the power-transmitting section 282 of the tubing string 210. The primary electrical function of the top isolator sub 240 is to insulate tubing pipe 216 from tubing pipe 217 while maintaining the necessary mechanical requirements.

In certain example embodiments, as shown in FIG. 3, an additional aperture 354 can be disposed within the insulator 353 between (and axially aligned with) the shell 352 and the aperture 355. In such a case, the aperture 354 can have a smaller width than the width of the aperture 351 and the aperture 355. For example, the aperture 351 and the aperture 355 can have a width that is substantially similar to the outer diameter of the tubing pipe 217 and the tubing pipe 216, respectively, where the aperture 354 can have a width that is substantially the same as the inner diameter of the tubing pipe 217 and/or the tubing pipe 216. Thus, the cavity 341 formed by the aperture 354 in the insulator 353 can have substantially the same size (e.g., width, circumference) as the size of the cavity 219 formed by the inner diameter of the tubing pipe 217 and/or the tubing pipe 216. In certain example embodiments, the shell 352 can have an open end at the bottom side of the top isolator sub 240. In such a case, a portion of the insulator 353 can be exposed to the cavity 225 of the casing 220.

In certain example embodiments, the bottom isolator sub 250 can be oriented in an inverse (e.g., upside-down) fashion relative to the top isolator sub 240. For example, the shell of the bottom isolator sub 250 can be mechanically (e.g., threadably) coupled to the top portion of the bottom neutral section 283 of the tubing string 210. Further, the insulator of the bottom isolator sub 250 can have an aperture that originates at the top portion of the insulator and traverses some or all of the bottom isolator sub 250. Such an aperture can be sized and have one or more of a number of features (e.g., mating threads) to receive and mechanically couple to the bottom portion of the power-transmitting section 282 of the tubing string 210. Further, an additional aperture can be disposed within the insulator between (and axially aligned with) the shell and the aperture of the bottom isolator sub 250.

Figure 4:
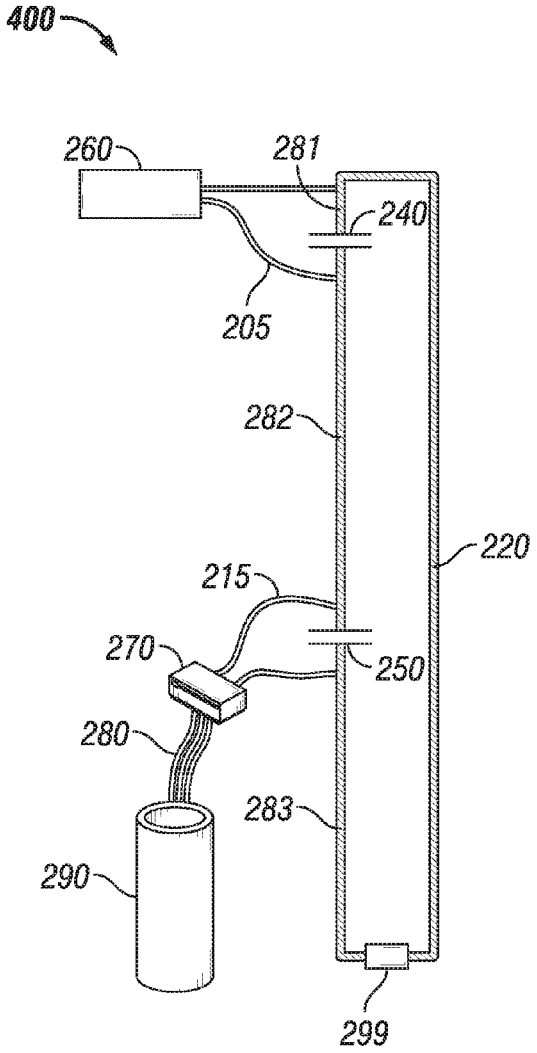
FIG. 4 shows an electrical schematic of an example piping system within a wellbore of a field in accordance with certain example embodiments.

FIG. 4 shows an electrical schematic 400 of the example piping system of FIG. 2, in accordance with certain example embodiments. Referring to FIGS. 1-4, the principal circuit in FIG. 4 originates with the power source 260, which sends power, using the cable 205, to the top portion of the power-transmitting section 282 of the tubing string 210, located just below the top isolator sub 240. The top isolator sub 240 can create a dielectric, physical break between the top neutral section 281 and the power-transmitting section 282 of the tubing string 210. The power then is transmitted down the power-transmitting section 282 of the tubing string 210 to the cable 215, which feeds the power to the power conditioner 270. The cable 215 is located just above the bottom isolator sub 250. In other words, the bottom isolator sub 250 creates a dielectric, physical break between the bottom neutral section 283 and the power-transmitting section 282 of the tubing string 210. The power conditioner 270 can send power (or a portion thereof, such as a neutral leg), using cable 417, to the bottom neutral section 283 of the casing string 210.

The conductive interface 299 can provide an electrical bridge between the bottom neutral section 283 of the tubing string 210 and the casing 220. The casing acts as an electrical ground and can be electrically coupled to the power source 260 to complete the primary circuit. A secondary circuit is also created by the power conditioner 270 by generating and sending conditioned power, using cable 280, to the electrical device 290. The power transmitted in the primary circuit of FIG. 4 can be single phase AC power, while the power used in the secondary circuit of FIG. 4 can be three-phase AC power.

Figure 5C:
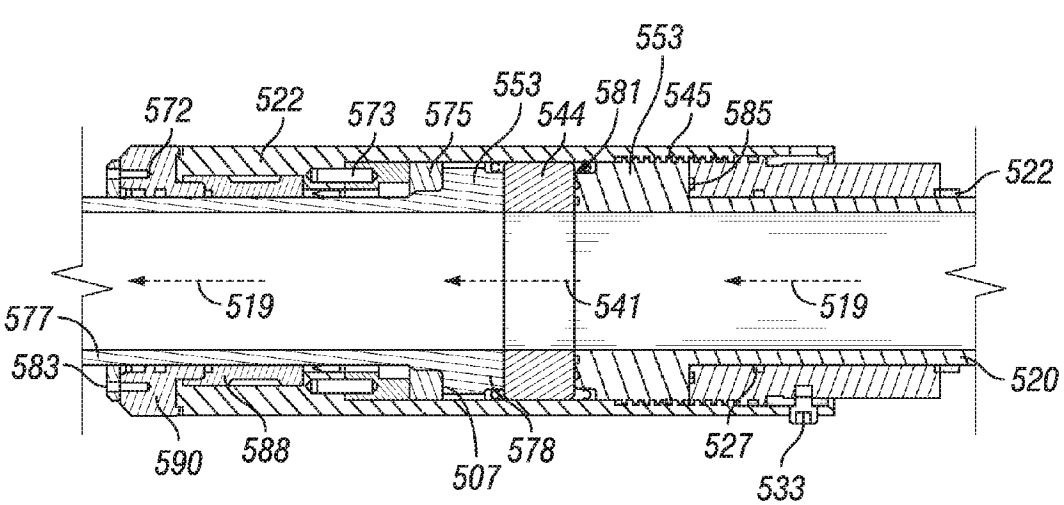
FIGS. 5A-5C show various views of an example isolator sub in accordance with one or more example embodiments.
Figure 5A:
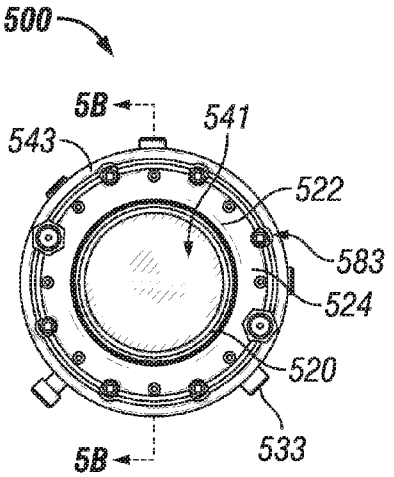
Figure 5B:
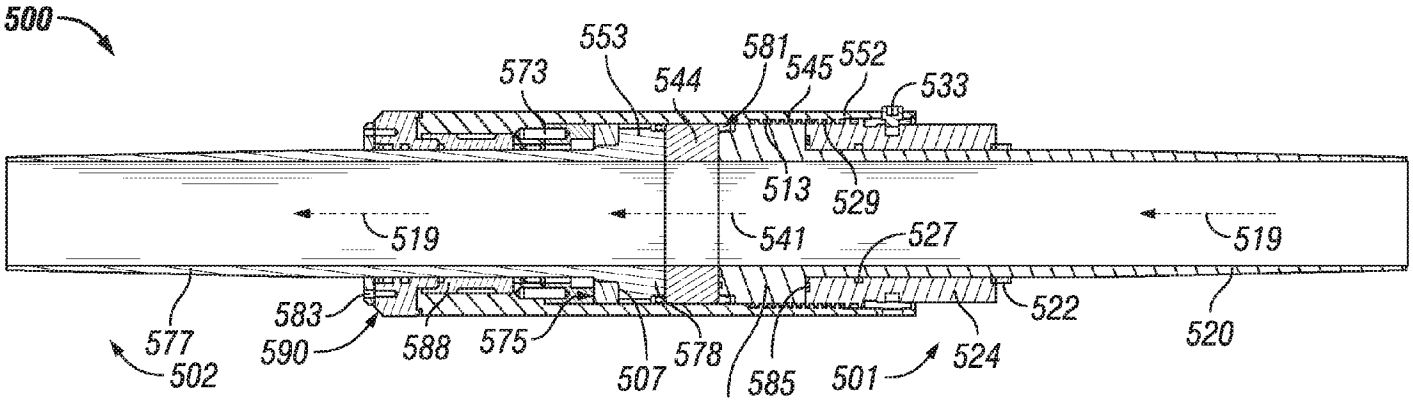

FIGS. 5A-5C show various views of an isolator sub 500 in accordance with one or more example embodiments. Specifically, FIG. 5A shows a top view of the isolator sub 500, and FIGS. 5B and 5C each shows a cross-sectional side view of the isolator sub 500. The isolator sub 500 of FIGS. 5A-5C has a different design than the isolator sub shown in FIG. 3. Here, the isolator sub 500 can be a top isolator sub and/or a bottom isolator sub. In one or more embodiments, one or more of the features shown in FIGS. 5A-5C may be omitted, added, repeated, and/or substituted. Accordingly, embodiments of an isolator sub should not be considered limited to the specific arrangements of components shown in FIGS. 5A-5C.

Referring now to FIGS. 1-5C, the example isolator sub 500 can be mechanically coupled (e.g., threadably, slotably, using fastening devices) to two tubing pipes, one on each end of the isolator sub 500. As discussed above with respect to FIG. 3, the isolator sub 500 can include a shell 552 and an insulator 553. The shell 552 and the insulator 553 can be coupled to each other in one or more of a number of ways. For example, as shown on the right side of FIGS. 5B and 5C, and insulator 553 can include threads 513 that threadably couple to threads 545 disposed on an inner surface 529 of the shell 552 of the isolator sub 500. As another example, as shown on the left side half of FIGS. 5B and 5C, the insulator 553 can be mechanically coupled to the shell 552 using one or more of a number of fastening devices (e.g., fastening devices 572, fastening devices 573, fastening devices 588, fastening devices 583) and other features (e.g., protrusion 507) to complement one or more features (e.g., collar 578) of the insulator 553 and/or the shell 552. In certain example embodiments, the fastening devices 572 are bolts, and the fastening devices 573 are pins.

In this example, the isolator sub 500 is disposed vertically within a cavity 225 of a casing 220 within a wellbore 120. As such, the isolator sub 500 can be capable of supporting weight (in the form of tubing string 210, one or more other isolator subs 250, a power conditioner 270, an electrical device 290, and/or any other component of the piping system 200) in excess of 100,000 pounds. Further, the isolator sub 500 can withstand extreme pressures (e.g., up to 10,000 pounds per square inch (psi)). In such a case, a number of sealing members (e.g., gaskets) can be disposed on various portions of the isolator sub 500. For example, as shown in FIGS. 5B and 5C, the isolator sub 500 can include sealing member 527, sealing member 522, sealing member 585, and sealing member 581 to prevent the ingress of fluids and gases up to a pressure of 10,000 psi.

The insulator 553 of the isolator sub 500 can include a number of pieces that are mechanically coupled to each other. For example, the insulator 553 of the isolator sub 500 of FIGS. 5A-5C can include member 577, central member 544, member 520, member 524, member 575, member 588, and member 590. Each member of the insulator 553 can mechanically couple to another member of the insulator 553 using one or more of a number of fastening features (e.g., fastening device, protrusion).

In certain example embodiments, the central member 544 of the insulator 553 physically separates an upper portion 501 from a lower portion 502 of the isolator sub 500. The thickness, material, and other characteristics of the central member 544 can vary to ensure that the power-transmitting section 282 of the tubing string 210 is electrically isolated from the top neutral section 281 of the tubing string 210 or the bottom neutral section 283 of the tubing string 210, as applicable. The central member 544 also includes an aperture 541 that traverses the central member 544. As described above with respect to FIG. 3, the aperture 541 can have a width that is substantially similar to the width of the sections of the tubing string 220 that mechanically couple to the isolator sub 500.

Further, the insulator 533 can have a cavity 519 on each side of the central member 544. In such a case, the cavity 519 is larger than the cavity 541 that traverses the central member 544. Specifically, as described above with respect to FIG. 3, the cavity 519 on each side of the central member 544 can have a width that is substantially the same as the inner diameter of the tubing pipe of the tubing string 210 that mechanically couples to the isolator sub 500.

The following description (in conjunction with FIGS. 1 through 5C) describes a few examples in accordance with one or more example embodiments. The examples are for transmitting power within a wellbore. Terminology used in FIGS. 1 through 5C is used in the provided examples without further reference to FIGS. 1 through 5C.

EXAMPLE 1

Consider the following example, which describes transmitting power within a wellbore in accordance with one or more example embodiments described above. The electrical device 290 in this case is a pump motor. Specifically, the pump motor is rated at 100 horsepower (HP) and requires 3-phase AC power of 500 volts at 300 amps. The 300 amps is generated by the power source 260, applied through the tubing string 210, conditioned by the power conditioner 270 (to create conditioned power), and delivered to the pump motor. The electric circuit is then complete when the power flows through the conductive interface 299 to the casing 220.

In such a case, the electrical pathway through the power-transmitting section 282 of the tubing string 210 and the casing 220 has an electrical resistance on the order of 3 ohms for 10,000 feet of length of the tubing string 210 and the casing 220 within the wellbore 120. Applying about 300 amps through 3 ohms results in about 1800 volts in the tubing string 210, which includes the voltage requirements of the pump motor. About 2300 volts (the sum of the loss through the power-transmitting section 282 of the tubing string 210 and the operating requirement of the pump motor) could be generated by the power source 260 and applied to the power-transmitting section 282 of the tubing string 210 to provide sufficient power to the pump motor. In other words, about one megawatt could be delivered by the power source 260 to the example piping system 200 to obtain approximately 300 kw of electrical power to the electrical device 290.

If the voltage requirement of the pump motor is about 2500 volts, then the current could be lowered to about 120 amps, and the loss in the power-transmitting section 282 of the tubing string 210 would be about 360 volts. In such a case, the power source 260 would need to generate about 2860 volts at 120 amps (344 kw) to operate the pump motor, where only 44 kw would be lost in transmitting the power through the power-transmitting section 282 of the tubing string 210, while the remaining approximately 300 kw would be used to operate the pump motor. With the latter example embodiment (where the power source 260 generates approximately 2500 volts), the piping system 200 requires better insulation (e.g., along the inner surfaces of the casing 220, along the outer surfaces of the power-transmitting section 282 of the tubing string 210) than what is required in the former example embodiment (i.e., the 500 volt system).

EXAMPLE 2

Consider another example, which describes transmitting power within a wellbore in accordance with one or more example embodiments described above. In this example embodiment, referring to FIGS. 1-5C, the electrical device 290 includes an electronics module and a 15 HP motor/pump unit. The power source 260 is a 180 kVA portable generator located at the surface 102 and rated at 240 VAC/300 A. The cable 205 that electrically couples the power source 260 to the power-transmitting section 282 of the tubing string 210 is a three conductor ESP (Electrical Submersible Pump) cable. Below the top isolator sub 240, an individual 240*v* circuit and ground were separated and attached to their respective contacts on the top isolator sub 240. The 240*v* "hot" side is attached to the lower contact of the top isolator sub 240, and the ground conductor is electrically coupled to the casing-grounded contact of the top isolator sub 240.

The power-transmitting section 282 of the tubing string 210 acts as the electrical conduit used to provide power to the electrical device, positioned below the bottom isolator sub 250. Electrically coupled to the bottom of the power-transmitting section 282 of the tubing string 210, just above the bottom isolator sub 250, is a cable 215 that includes three 100 foot conductors. One conductor is electrically coupled to the electronics module, another conductor is electrically coupled to the 15 HP motor/pump unit, and the third conductor is electrically coupled to ground. Between the motor/pump unit and the electronics module, a conductive interface 299 in the form of a torque anchor is electrically coupled to the casing 220 for a return ground path from the power-transmitting section 282 of the tubing string 210 to the casing 220 and back to the power source 260. The torque anchor also provides additional centralization of the tubing string 210 from the casing 220.

In this example, a plastic electrically non-conductive centralizer 230 is placed and secured at every coupling of two tubing pipes of the tubing string 210. The 15 HP motor/pump unit is rated to pump an 850 foot column of water. A sonic fluid test confirms that the fluid level in the wellbore 120 is 1087 feet below the surface 102. The power source 260 generates and delivers to the power-transmitting section 282 of the tubing string 210 a voltage of 240 VAC with a 60-70 ampere draw. After running the power source 260 for 15 minutes, the power source 260 is turned off. With the power source 260 off, the surface cable is disconnected and an additional sonic fluid test is conducted. The subsequent sonic fluid test indicates a fluid level at approximately 310 ft. below the surface 102. To further confirm pumped fluid, as the tubing string 210 is being pulled out of the wellbore 120, a calculation is performed at the 11th-12th tubing joint (each joint is approximately 30 feet long), and a confirmation is made that the motor/pump unit performed as expected. This indicates that conditioned power delivered to the motor/pump unit is sufficient for rated operation of the motor/pump unit using an example embodiment.

Figure 6:
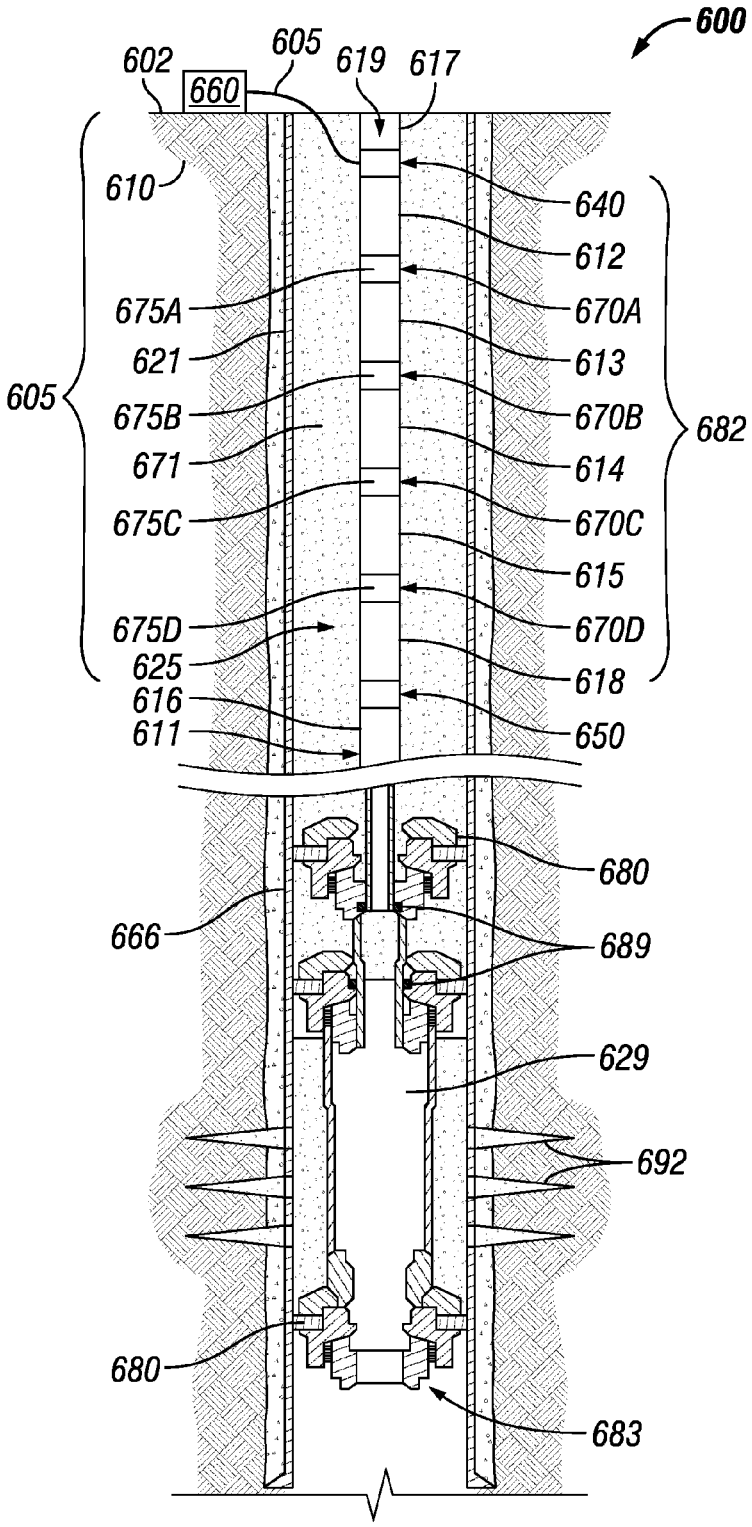
FIG. 6 shows a cross-sectional side view of a piping system in accordance with one or more example embodiments.

FIG. 6 shows a cross-sectional side view of a production wellbore 600 that includes a number of gas lift valve assemblies 670 integrated with the delivery system 605 in accordance with certain example embodiments. In one or more embodiments, one or more of the features shown in FIG. 6 may be omitted, added, repeated, and/or substituted. Accordingly, embodiments of a production wellbore should not be considered limited to the specific arrangements of components shown in FIG. 6. The various components (e.g., power source 660) of the production wellbore 600 are substantially similar to the corresponding components (e.g., power source 260) described above, except as described below.

Referring to FIGS. 1-6, the production wellbore 600 includes a power source 660 and a delivery system 605 for delivering power (e.g., power signals) generated by the power source 660 to the gas lift valve assemblies 670. In this case, there are four gas lift valve assemblies 670, which include gas lift valve assembly 670A, gas lift valve assembly 670B, gas lift valve assembly 670C, and gas lift valve assembly 670D. The delivery system 605 includes a number of tubing pipes (e.g., tubing pipe 612, tubing pipe 613, tubing pipe 614, tubing pipe 615, tubing pipe 618) that make up a tubing string 611. Tubing pipe 612, tubing pipe 613, tubing pipe 614, tubing pipe 615, and tubing pipe 618 make up the power-transmitting section 682 of the tubing string 611 and are disposed between upper isolation sub 640 and lower isolation sub 650.

Upper isolation sub 640 is disposed between and coupled to tubing pipe 612 (part of the power-transmitting section) and tubing pipe 617, which is part of the top neutral section of the tubing string 611 and is not part of the delivery system 605. An electrical cable 605 is coupled to the power source 660 at one end and the upper isolation sub 640 at the other end. The electrical cable 605 can be considered part of the delivery system 605.

Each gas lift valve assembly 670 in FIG. 6 is coupled, at the top and bottom end, to a tubing pipe of the tubing string 611. Specifically, gas lift valve assembly 670A is disposed between and coupled to tubing pipe 612 and tubing pipe 613. Gas lift valve assembly 670B is disposed between and coupled to tubing pipe 613 and tubing pipe 614. Gas lift valve assembly 670C is disposed between and coupled to tubing pipe 614 and tubing pipe 615. Gas lift valve assembly 670D is disposed between and coupled to tubing pipe 615 and tubing pipe 618. The number of gas lift valve assemblies 670 can be more (e.g., five, seven) or less (e.g., one, two) than the four shown in FIG. 6.

The top and bottom of each gas lift valve assembly 670 can be configured similar to the top and bottom of each tubing pipe in the tubing string 611. For example, if each tubing pipe in the tubing string 611 has mating threads disposed on an outer surface of the top of the tubing pipe, and mating threads disposed on an inner surface of the bottom of the tubing pipe, then each gas lift valve assembly can also have mating threads disposed on an outer surface of the top of the body 675 of the gas lift valve assembly 670, and mating threads disposed on an inner surface of the bottom of the body 675 of the gas lift valve assembly 670.

In certain example embodiments, the body 675 of the gas lift valve assembly 670 is electrically conductive. In this way, each of the gas lift valve assemblies 670 of FIG. 6 can be part of the power-transmitting section 682. In other words, the power generated by the power source 660 in FIG. 6 flows through the electrical cable 605, through the upper isolation sub 640, through the tubing pipe 612, through the gas lift valve assembly 670A, through the tubing pipe 613, through the gas lift valve assembly 670B, through the tubing pipe 614, through the gas lift valve assembly 670C, through the tubing pipe 615, through the gas lift valve assembly 670D, and through tubing pipe 618. If there is an optional lower isolation sub 650, as shown in FIG. 6, then the power subsequently flows through the lower isolation sub 650.

The delivery system 605 (including a portion of the electrical cable 619) and the gas lift valve assemblies 670 are all disposed within a cavity 625 (also called an annular space 625) formed by the casing 621 throughout the wellbore 620. Also disposed in the annular space 625 between the casing 621 and the drill string 611, up to the packers 680, is the control medium 671. The casing 621 can have multiple sections (e.g., multiple casing pipes, footings) that are coupled to and/or layered within each other. In some cases, as the depth in the wellbore 620 increases, the diameter of the casing 621 is stepped downward relative to the diameter of sections of the casing 621 that is closer to the surface 602. The delivery system 605 can be long enough so that the gas lift valve assemblies 670 are positioned at a certain depth below the surface 602 (or, alternatively, the water level or the mudline, depending on the location of the wellbore). The casing 621 of FIG. 6 can be substantially similar to the casing (e.g., casing 220) described above.

Toward the bottom of the wellbore 620 within the cavity 625 is one or more packers 680 and one or more seals 689. The packers 680 and/or seals 689 can be a conductive interface to provide a return path for the power delivered to the gas lift valve assemblies 670. Below the packers 680 and seals 689 is a production zone 629 having a number of perforations 692 that extend through the casing 621 and the wellbore 620 into the formation 610. The perforations 692 allow production fluid (also called a subterranean resource) to flow from a reservoir in the formation 610 into the production zone 629. Below the perforations 692 within the wellbore 620 can be positioned another packer 680 that is mechanically coupled to an end cap 683.

Figure 7A:
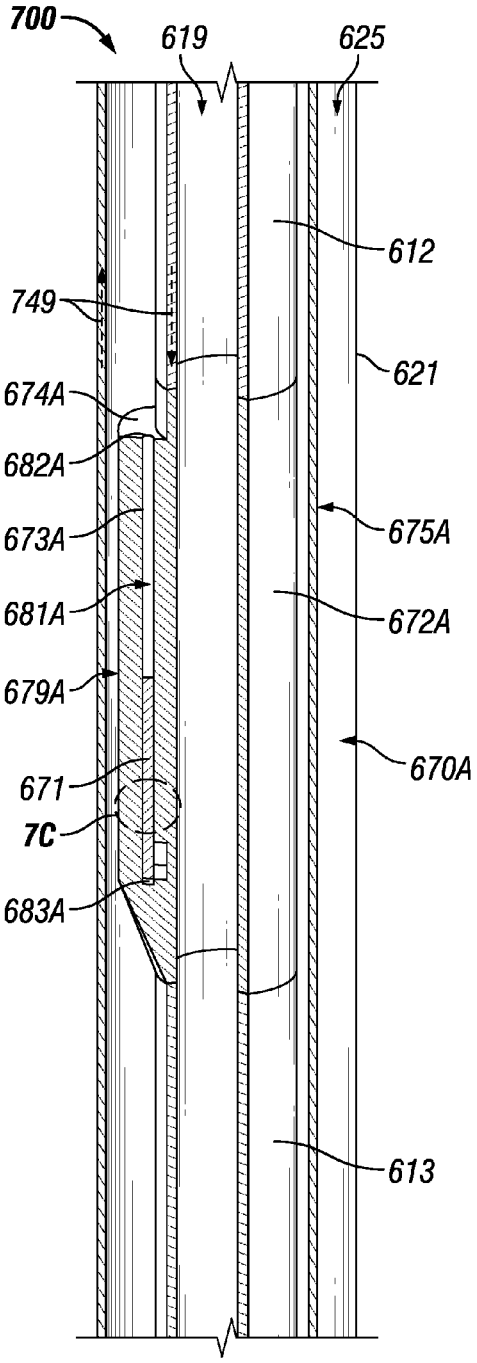
FIGS. 7A-7C show a gas lift valve assembly in accordance with one or more example embodiments.
Figure 7C:
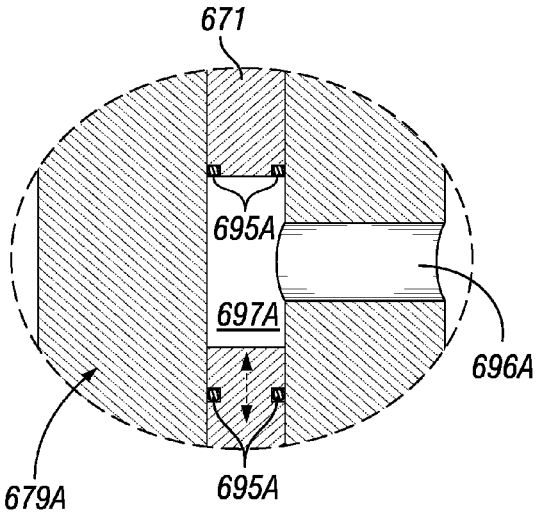
Figure 7B:
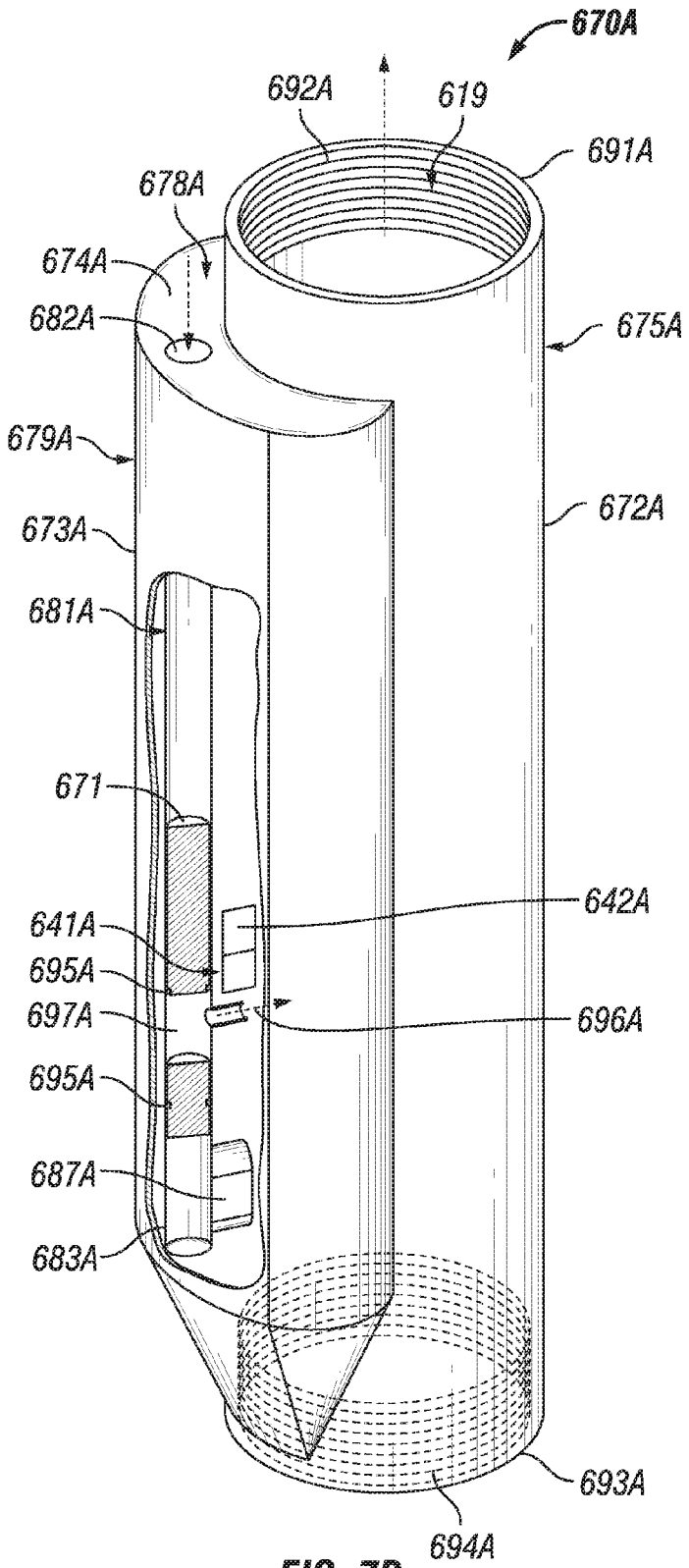

FIGS. 7A-7C show a subsystem 700 that includes gas lift valve assembly 670A from the production wellbore 600 of FIG. 6 in accordance with one or more example embodiments. Specifically, FIG. 7A shows a cross-sectional side perspective view of the subsystem 700, and FIG. 7B shows a semi-transparent top-side perspective view of the gas lift valve assembly 670A. The subsystem 700 of FIG. 7A includes tubing pipe 612, tubing pipe 613, and gas lift valve assembly 670A disposed between and coupled to tubing pipe 612 and tubing pipe 613.

FIG. 7B shows the coupling features 692A disposed toward the top end 691A of the gas lift valve assembly 670A and the coupling features 694A disposed toward the bottom end 693A of the gas lift valve assembly 670A. In this case, the coupling features 692A are mating threads disposed on the inner surface of the wall 672A that forms part of the body 675A. Alternatively, the coupling features 692A can be disposed on the outer surface of the wall 672A and/or the coupling features 692A can be something other than mating threads. Also, the coupling features 694A are mating threads disposed on the outer surface of the wall 672A. Alternatively, the coupling features 694A can be disposed on the inner surface of the wall 672A and/or the coupling features 694A can be something other than mating threads.

The body 675A of the gas lift valve assembly 670A can include multiple portions. For example, as shown in FIGS. 7A-7C, the body 675A can include at least one wall 672A and an extension 679A that extends outward from a portion of the wall 672A. The wall 672A can form a cavity 619 that traverses the length of the gas lift valve assembly 670A, where the cross-sectional shape (e.g., circular) and size (e.g., diameter) of the cavity 619 is substantially the same as the cross-sectional shape and size of the cavity 619 formed by tubing pipe 612 and tubing pipe 613, to which the gas lift valve assembly 670A is coupled. In certain example embodiments, the wall 672A is electrically conductive, so that the power 749 flowing down the tubing string (tubing pipe 612, tubing pipe 613) also flows through the gas lift valve assemblies 670 (in this case, gas lift valve assembly 670A).

The extension 679A of the body 675A can have one or more of a number of components and/or configurations. For example, as shown in FIGS. 7A-7C, the extension 679A can include an extension wall 673A that forms a chamber 678A inside of which can be disposed an inlet channel 681A, a valve 697A, an outlet channel 696A, a controller 641A, optional sensor devices 642A, and a retrieval port 687A. The retrieval port 687A is similar to what is found in gas lift valve assemblies currently known in the art. In some embodiments, the retrieval port 687A may be located in a different portion of the gas lift valve assembly 670A. Specifically, with gas lift valve assemblies currently known in the art, a gas lift valve assembly must maintain a pressure gradient from the cavity 619 of the tubing string (including the cavity 619 of the gas lift valve assembly) to the annular space 625.

Figure 8A:
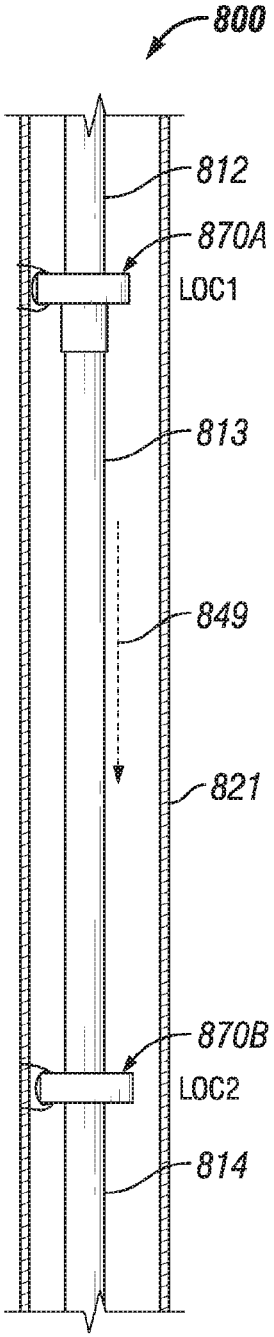
FIGS. 8A and 8B show a cross-sectional side view and a single line diagram, respectively, of a subsystem in accordance with one or more example embodiments.
Figure 8B:
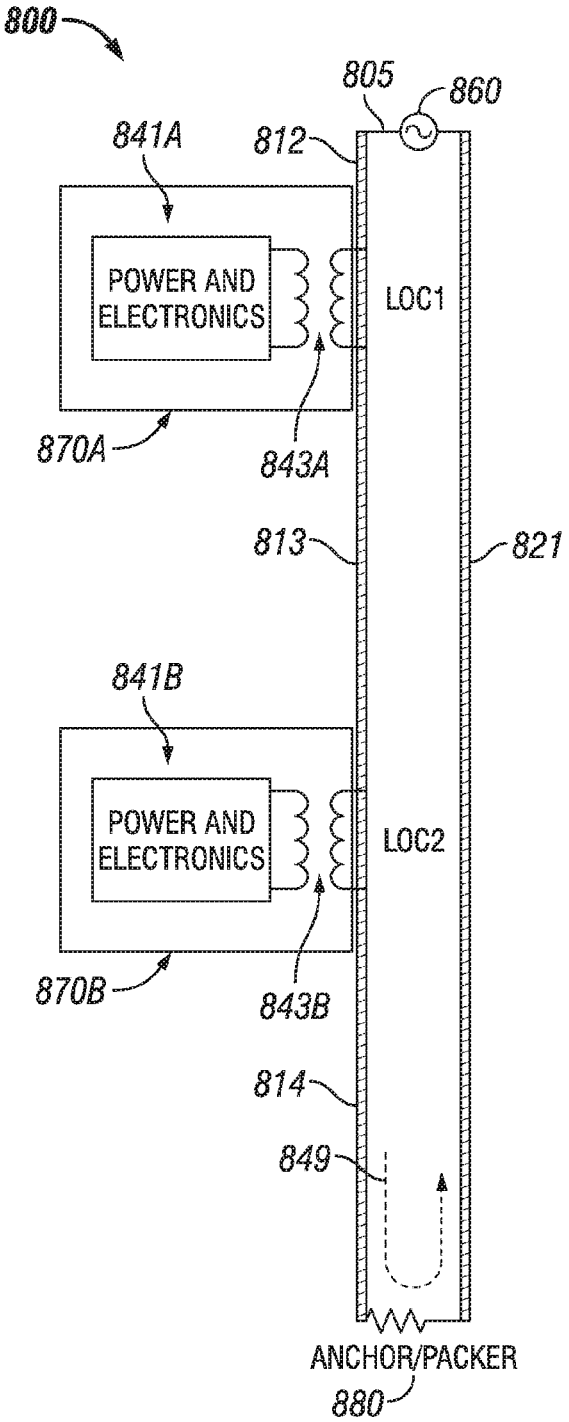

When multiple gas lift valve assemblies are used (as shown in FIGS. 8A and 8B below), the gas lift startup procedure begins with the injection of the less-dense fluid (control medium 671) from the surface 102 in the annular space 625. In the initial range of surface pressures applied to inject the control medium 671 in the annular space 625, the gas lift valve assembly that is located closest to the surface 102 opens its valve so that the initial fluid, normally not the control medium, is displaced from the annular space 625 by the control medium 671. Once the initial annular fluid that originally spanned the areas from the surface 102 to the first gas lift assembly is displaced, the control medium 671 flows from the annular space 625 into the cavity 619 of the tubing string and mixes with the subterranean resource in the cavity 617 between that first gas lift valve assembly and the surface 102.

As the surface pressure further changes so that the original annular fluid that fills the subsequent section of the annual space 625, between the first gas lift valve assembly 670A and the second gas lift valve assembly 670B (the two gas lift valve assemblies 670 located closest to the surface 102), can be displaced by the control medium 671, the second gas lift valve assembly 670B opens its valve. The valve 697A of the first gas lift valve assembly 670A remains open until the valve of the second gas lift valve assembly 670B begins injecting the control medium 671 into the cavity 619 and the pressure within the tubing string cavity 619 decreases and falls outside of the operating pressure range of the valve 697A of the first gas lift valve assembly 670A. The subsequent gas lift valve assembly 670C (third from the surface 102) in the wellbore 120 then performs the same function, and so on by induction, until the entire annular space 625 has been displaced and is filled with the control medium 671, with only the furthest (last) gas lift valve assembly from the surface 102 remaining open.

In the current state of the art, gas lift valves include a check valve mechanism that prevents fluid in the tubing string cavity 619 from flowing into the annular space 625. However, this check mechanism is not designed to sustain pressure differentials often achieved during reservoir remedial operations (e.g., as acid injection), or well maintenance operations (e.g., completion hardware replacement). In order to ensure proper pressure containment during various operations, such as those described in the previous sentence, any gas lift valve 697 within the gas lift assemblies 670 in the wellbore 120 must be replaced by a "dummy valve". The "dummy valve" is effectively a metal plug that fits in and blocks the inlet channel 681A, is rated to sustain operating pressures, and ensures that no fluid can flow from the tubing string cavity 619 to the annular space 625. The retrieval port 687A is used during a wireline operation to swap between the valve 697A and the dummy valve, or to replace a failed valve 697A. Any of these processes are time-consuming, expensive, and can cause complications if a valve or dummy valve is dropped from the retrieval wireline tool into the wellbore. The recovery effort, known as a "fishing job", may cause further costs to the operation and includes the risk of well abandonment should the retrieval attempt fail.

The inlet channel 681A of the gas lift valve assembly 670A can have one or more portions. For example, as shown in FIGS. 7A-7C, the inlet channel 681A can have a top portion 682A and a bottom portion 683A. The top portion 682A can protrude through the top 674A of the extension 679A and be exposed to the environment in the annular space 625, which is defined as the volume of space within the casing 621 but outside the tubing string. During a field operation to extract subterranean resources, the annular space 625 includes a control medium 671. The inlet channel 681A can also protrude radially rather than axially (with a top 682A and a bottom 683A) along the length of the gas lift valve assembly 670A.

The control medium 671 has a density that is less than the density of a subterranean resource (e.g., oil, natural gas) disposed within the cavity 619 and which is being extracted during a field operation. For example, the control medium 671 can be a natural gas if the subterranean resource is crude oil. By injecting the lower density control medium 671 into the cavity 619, the control medium 671 forces the subterranean resource toward the surface 602. The control medium 671 can flow into the inlet channel 681A, to the valve 697A, which then controls its flow through the outlet channel 696A into the tubing string.

The bottom portion 683A of the inlet channel 681A has the valve 697A disposed therein. The valve 697A can include one or more portions and have any of a number of configurations. For example, as shown in FIGS. 7A-7C, the valve 697A slides within the inlet channel 681A between stops 695A that protrude inward from the surface of the inlet channel 681A. The stops 695A limit the travel both the upward and downward travel of the valve 697A within the inlet channel 681A. When the valve 695A abuts against the upper stop 695A, the valve 697A blocks the control medium 671 from flowing into the cavity 619, and the valve 697A also blocks the mixture of the control medium 671 and the subterranean resource to flow from the cavity 619 into the annular space 625.

When the valve 697A abuts against the lower stop 695A, the outlet channel 696A becomes directly accessible to the inlet channel 681A. As a result, if the control medium 671 has not sufficiently adjusted the pressure within the cavity 619, the control medium 671 flows into the cavity 619, unobstructed by the valve 697A. Alternatively, if the control medium 671 has sufficiently adjusted the pressure within the cavity 619, it is possible that the mixture of the control medium 671 and the subterranean resource can flow from the cavity 619 into the annular space 625. With example embodiments, the movement of the valve 697A between the stops 695A is controlled by the controller 641A, which can be integrated with the valve 697A. The physical control mechanism can use one or more of a number of methods and/or devices, including but not limited to an actuator (e.g., electromagnetic, piezoelectric, linear, rotational), and a controller that applies a control law that commands the actuator accordingly.

The valve 697A can have any of a number of positions. For example, the valve 697A can be fully closed. As another example, the valve 697A can be fully open. As yet another example, the valve 697A can be anywhere between fully closed and fully open. In this case, the position of the valve 697A within the inlet channel 681A is based on the power 749 (e.g., frequency, voltage level) flowing through the delivery system 605, including through the body 675A of the gas lift valve assembly 670A.

As discussed above, the valve 697A is moved from one position within the inlet channel 681A to another by the controller 641A. In certain example embodiments, the controller 641A is integrated with (part of) the valve 697A. The controller 641A can be electrically coupled to a toroidal core transformer (described below with respect to FIGS. 8A and 8B) or some similar component that creates signals (e.g., power signals, control signals, communication signals) from power 749 transmitted through the tubing string and that can be used by the controller 641A. When the controller 641A is part of the valve 697A, the valve 697A can be coupled to the body 675 (also called a mandrel 675) of the gas lift valve assembly 670A electromagnetically.

The controller 641A receives the transformed power, interprets to what extent, if any, the position of the valve 697A should be changed, and changes the position of the valve 697A accordingly. The controller 641A can include one or more of a number of components, including but not limited to a hardware processor, switches, gate arrays, and an integrated circuit. In certain example embodiments, when the controller 641A receives the transformed power, the controller 641A can also control the operation of one or more other components of the gas lift valve assembly 670A. For example, if the gas lift valve assembly 670A includes one or more sensor devices 642A (e.g., a gas flow sensor), the controller 641A can use the transformed power to operate the sensor devices 642A.

As discussed above, the purpose of a gas lift valve assembly (e.g., gas lift valve assembly 670A) is to decrease the hydrostatic pressure of fluid in the cavity 619 by injecting the control medium 671, which has a lower density than the density of the subterranean resource within the cavity 619. As a result of the control medium 671 being introduced into the cavity 619, the subterranean resource is raised toward the surface 602 with less energy manifested by lower pressure "loss". While the goal is to inject the control medium 671 at the deepest possible point within the cavity 619, often times a number of gas lift valve assemblies 670, as shown in FIG. 6, are used along the length of the tubing string to more effectively start the process of lifting the subterranean resource toward the surface 602. During the start of the injection process, as the injected control medium 671 the fluid in the annular space 625 and reaches each lower-positioned gas lift valve assembly 670B, the hydrostatic head in the wellbore 620 incrementally decreases, requiring less surface pressure to displace the next increment of fluid in the annular space 625, until the gas lift valve assembly 670A closest to the surface 602 (in this case, gas lift valve assembly 670B) is reached. The valve 697A in the higher-positioned gas lift valve assembly 670A then closes, and the cycle is repeated until the lower-most gas lift valve assembly (in this case, gas lift valve assembly 670D) is reached, which then remains as the sole injection point for the control medium 671 along the tubing string.

When systems having multiple gas lift valve assemblies are used in the current art, complications can arise. For example, there can be oscillating instabilities of flow and pressure within the cavity 619. These situations can lead to damaging hardware (e.g., one or more gas lift valve assemblies) and/or decreasing the amount of subterranean resource that is extracted. As another example, during any workover or well-maintenance operation, the valve of each of the gas lift valve assemblies currently used in the art must be replaced with "dummy" valves (usually with a wireline operation) that can withstand the pressure differential between the cavity 619 of the tubing string and the annular space 625 to ensure that, for example, any injected fluid within the wellbore 620 does not migrate into the annular space 625 or any other undesirable location to the specific workover operation. The replacement procedure currently poses a number of risks to the operation, including the loss of hardware, leakage of dummy valves, or other issues that are either time consuming to resolve or may require the abandonment of the wellbore 620. Further, the valves of the gas lift valve assemblies currently used in the art are passively actuated based on the pressures within the wellbore 620 and can effectively only operate in a fully-open or closed position. Thus, these systems using gas lift valve assemblies currently used in the art do not allow for active control of the gas lift valve assemblies, which may ameliorate some of the aforementioned complications.

In certain example embodiments, when multiple gas lift valve assemblies 670 are used, active control of each valve 697 is possible. Specifically, as shown in FIG. 9 below, a controller 641 can be configured to recognize certain characteristics (e.g., frequency, range of frequencies, voltages, range of voltages) of the power 749 that flows through the tubing string and ignore the power 749 that does not have those characteristics.

FIGS. 8A and 8B show a cross-sectional side view and a single line diagram, respectively, of a subsystem 800 in accordance with one or more example embodiments. Any components of the subsystem 800 of FIGS. 8A and 8B are substantially the same as a corresponding component described above with respect to FIGS. 6-7B. The numbering scheme for the components in FIGS. 8A and 8B parallel the numbering scheme for the components of previously described figures in that each component is a three digit number having either the identical last two digits.

In certain example embodiments, the subsystem 800 of FIGS. 8A and 8B have two gas lift valve assemblies (gas lift valve assembly 870A and gas lift valve assembly 870B) connected in series as part of the tubing string. Each gas lift valve assembly 870 in this case has a toroidal core transformer 843 that wraps around the wall of the body of the gas lift valve assembly 870. The power 849 that flows through the wall of the body of the gas lift valve assembly 870 is induced in the primary winding of the toroidal core transformer 843 and transformed to the secondary winding of the toroidal core transformer 843. As a result, each controller 841, which is electrically coupled to the toroidal core transformer 843, uses the transformed power (which can include individually-addressed control signals) to operate the valve 897, the optional sensor devices 842 (e.g., pressure sensor, temperature sensor, gas flow sensor), and/or some other component of the corresponding gas lift valve assembly 870.

Figure 9:
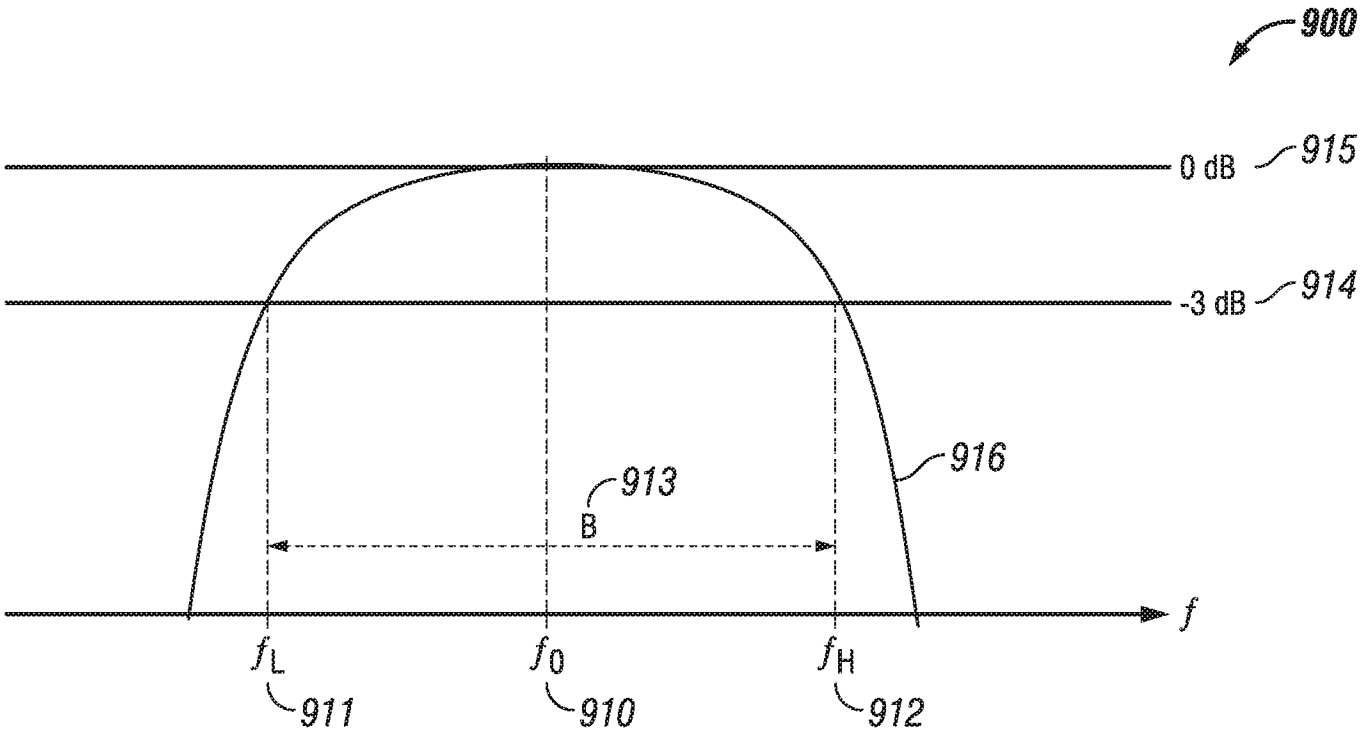
FIG. 9 shows a graph of a bandpass filter used in accordance with one or more example embodiments.

FIG. 9 shows a graph 900 of a bandpass filter used in accordance with one or more example embodiments. The bandpass filter can be part of the controller of a gas lift valve assembly. The graph 900 shows a range 913 of frequency 916 ranging from a low frequency 911 to a high frequency 912, which each register at approximately −3 dB 914. Midway between the low frequency 911 and the high frequency 912 is a mid-frequency 910 which registers at 0 dB 915, and it does so for most of the range between the low frequency 911 and high frequency 912. If any power (e.g., power 849) flowing through the wall of the body of a gas lift valve assembly has a frequency 916 lower than the low frequency 911 or higher than the high frequency 912 is ignored by the controller. Conversely, if any power (e.g., power 849) flowing through the wall of the body of a gas lift valve assembly has a frequency 916 between the low frequency 911 and the high frequency 912, inclusive, the power is recognized and used by the controller.

Figure 10:
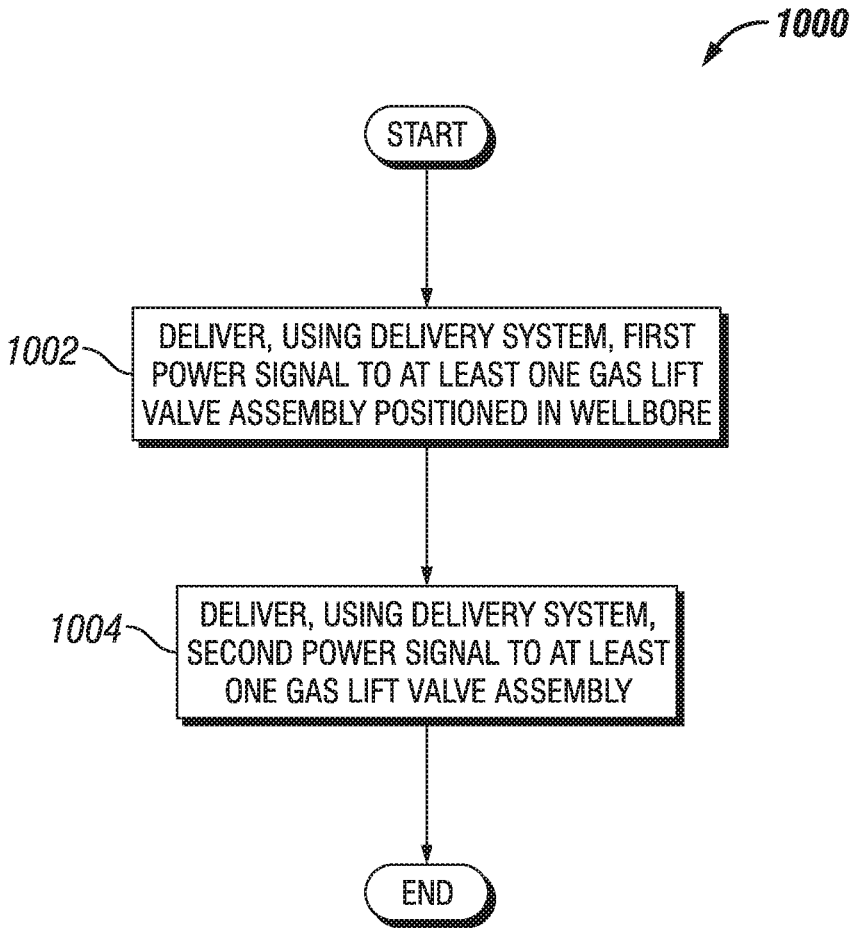
FIG. 10 shows a flow chart of a method for extracting a subterranean resource from within a wellbore in accordance with one or more example embodiments.

FIG. 10 shows a flow chart of a method 1000 for extracting a subterranean resource from within a wellbore in accordance with one or more example embodiments. While the various steps in this flowchart are presented and described sequentially, one of ordinary skill will appreciate that some or all of the steps may be executed in different orders, may be combined or omitted, and some or all of the steps may be executed in parallel. Further, in certain example embodiments, one or more of the steps described below may be omitted, repeated, and/or performed in a different order. In addition, a person of ordinary skill in the art will appreciate that additional steps, omitted in FIG. 10, may be included in performing these methods. Accordingly, the specific arrangement of steps shown in FIG. 10 should not be construed as limiting the scope.

Referring now to FIGS. 1-10, the example method 1000 begins at the START step and continues to step 1002. In step 1002, a first power signal 749 is delivered to at least one gas lift valve assembly 670 positioned in the wellbore 620. The first power signal 749 can be generated by a power source 660 and delivered using a delivery system 605. An example of such a delivery system 605 for the power can be the system 600 described above with respect to FIG. 6. There can be one gas lift valve assembly 670 or a number of gas lift valve assemblies 670 positioned (e.g., in series) in the wellbore 620. The gas lift valve assemblies 670 can be mechanically coupled in series with a one or more tubing pipes (e.g., tubing pipe 612, tubing pipe 613) of the tubing string, where a tubing pipe is coupled to and disposed above a gas lift valve assembly 670, while another tubing pipe is coupled to and disposed below a gas lift valve assembly 670.

In certain example embodiments, the first power signal 749 delivered to the gas lift valve assemblies 670 can have certain characteristics (e.g., frequency, voltage) that allow a controller 641 of a gas lift valve assembly 670 to receive the first power signal 749 and operate a component (e.g., valve 697) using the first power signal 749. For example, the first power signal 749 can instruct a controller 641 of a gas lift valve assembly 670 to adjust the position of a valve 697 of the gas lift valve assembly 670. Conversely, the characteristics of the first power signal 749 can cause the first power signal 749 to be ignored by the controller 641 of a gas lift valve assembly 670. The first power signal 749 delivered through the delivery system 605 can be received by a controller 641 using a transformer 843.

In step 1004, a second power signal 749 is delivered at least one gas lift valve assembly 670 positioned in the wellbore 620. The second power signal 749 can be generated by a power source 660 and delivered using a delivery system 605. The one or more gas lift assemblies 670 receiving the second power signal 749 can be the same as or different than the one or more gas lift assemblies 670 receiving the first power signal 749. The second power signal 749 can have at least one characteristic that is different from a corresponding characteristic of the first power signal 749. When step 1004 is finished, the process can proceed to the END step.

Alternatively, any of a number of additional power signals 749 can be delivered subsequent to the second power signal 749.

In certain example embodiments, the second power signal 749 delivered to the gas lift valve assemblies 670 can have certain characteristics (e.g., frequency, voltage) that allow a controller 641 of a gas lift valve assembly 670 to receive the second power signal 749 and operate a component (e.g., valve 697) using the second power signal 749. For example, the second power signal 749 can instruct a controller 641 of a gas lift valve assembly 670 to adjust the position of a valve 697 of the gas lift valve assembly 670. Conversely, the characteristics of the second power signal 749 can cause the second power signal 749 to be ignored by the controller 641 of a gas lift valve assembly 670. The second power signal 749 delivered through the delivery system 605 can be received by a controller 641 using a transformer 843.

The systems, methods, and apparatuses described herein allow for transmitting power within a wellbore. Major components in such a configuration may include conventional oil production tubing pipe, conventional oilfield production casing pipe, multiple example isolator subs, and insulation systems. Such insulation systems may be designed to insulate the tubing string from the casing at each end of the wellbore. Further, there may be a conductive interface (e.g., anchor, packer assembly) that may provide electrical conductive contact from the production tubing to the casing, providing a return circuit toward the end of the tubing string.

Using example embodiments described herein, it is possible to use the existing metallic (or otherwise electrically conductive) structure of the constructed well as the electrical conductor set to supply energy for moderate to high power equipment that is located within a wellbore. For example, example embodiments may be employed to supply power of 100 VA-1 MVA to an electrical device, although less or more power could be employed. Supply of power using existing wellbore hardware, such as a tubing string and casing, may reduce or eliminate the need for conventional power cabling completion insertions. The application of example embodiments may employ relatively high current and moderately high voltage use of the well structure.

Further, using example embodiments described herein, it is possible to use the existing metallic (or otherwise electrically conductive) structure of the constructed well (e.g., tubing string) as the electrical conductor to supply energy to one or more gas lift valve assemblies located within a wellbore. For example, one or more example gas lift valve assemblies can be coupled in series with tubing pipe of a tubing string. In such a case, the example gas lift valve assemblies can harvest the power (for example, using a magnet and at least one inductor), and a controller of the example gas lift valve assembly can interpret whether that power is intended for use by that gas lift assembly valve. If the power is intended for use by that gas lift assembly valve, then the controller controls and/or applies the power to one or more components (the valve) of the gas lift valve assembly. If the power is not intended for use by that gas lift assembly valve, then the controller does nothing with (ignores) the power.

The controller can also send signals, using the delivery system, to a user at the surface. For example, the controller can send readings of a sensor device (e.g., a gas flow sensor) to a user through the delivery system. The use of example gas lift valve assemblies, as described herein, provides a number of advantages over gas lift valve assemblies currently used in the field. For example, the valves of gas lift valve assemblies described herein do not need to be replaced with "dummy" valves during a workover operation. Instead, power received by example gas lift valve assemblies can instruct the controller of the corresponding gas lift valve assembly to move to corresponding valve to a fully-closed position when the gas lift valve assembly is not being used. Using example embodiments also provides significant cost and time savings, a higher level of reliability, greater ease of use, and significantly more effective extraction of subterranean resources.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A gas lift valve system for a wellbore within a subterranean formation, the system comprising:

a power source that generates power;

a delivery system disposed within the wellbore and electrically coupled to the power source, wherein the delivery system delivers the power generated by the power source, wherein the delivery system comprises a tubing string, wherein the tubing string comprises a plurality of electrically conductive tubing pipes mechanically coupled end-to-end and through which the power flows, wherein the tubing string forms a first cavity that runs along its length;

at least one gas lift valve assembly disposed within the wellbore and electrically coupled to the delivery system, wherein the at least one gas lift valve assembly comprises an inlet channel, an outlet channel, and at least one valve disposed between the inlet channel and the outlet channel, wherein the at least one valve has a plurality of positions, wherein the plurality of positions comprises a fully-closed position, wherein the at least one gas lift valve assembly receives the power from the delivery system, wherein the power received from the delivery system determines a position of the plurality of positions of the at least one valve, and wherein the at least one valve, when in a position other than the fully closed position, allows a control medium to flow from the inlet channel to the outlet channel, wherein the outlet channel empties into the first cavity;

a casing disposed within the wellbore and comprising a plurality of electrically conductive casing pipes mechanically coupled end-to-end, wherein the casing has a second cavity running therethrough;

a first isolator sub mechanically coupled to and positioned between a top neutral section and a power-transmitting section of the tubing string, wherein the first isolator sub has the first cavity running therethrough, and wherein the first isolator sub electrically separates the casing from the tubing string and the top neutral section from the power-transmitting section;

a second isolator sub mechanically coupled to the tubing string and positioned between a bottom neutral section and the power-transmitting section of the tubing string, wherein the second isolator sub has the first cavity running therethrough, and wherein the second isolator sub electrically separates the bottom neutral section from the power-transmitting section; and a conductive interface disposed within the second cavity, wherein the conductive interface electrically couples the casing and the tubing string, wherein the at least one gas lift valve assembly is disposed below the first isolator sub and is electrically and mechanically coupled to the power-transmitting section of the tubing string, wherein the tubing string and the first isolator sub are disposed within the second cavity without contacting the casing, wherein the top neutral section of the tubing string is positioned proximate to an entry point of the wellbore, and wherein the bottom neutral section of the tubing string is positioned toward a distal end of the wellbore, wherein the power-transmitting section of the tubing string is positioned between the top neutral section and the bottom neutral section.

2. The system of claim 1, wherein the conductive interface comprises at least one selected from a group consisting of a packer, an anchor assembly, and a seal.

3. The system of claim 2, wherein the control medium is disposed in the second cavity outside the first cavity and enters the inlet channel of the at least one gas lift valve assembly.

4. The system of claim 1, wherein the casing is an electrical ground for an electric circuit that comprises the power generated by the power source.

5. The system of claim 1, wherein the power source is further electrically coupled to the casing.

6. The system of claim 1, wherein the at least one gas lift valve assembly comprises a first gas lift valve assembly disposed at a first location in the wellbore and a second gas lift valve assembly disposed at a second location in the wellbore, wherein the first location is closer to a surface relative to the second location.

7. The system of claim 6, wherein the power comprises a first power signal having a first frequency that is recognized by the first gas lift valve assembly and ignored by the second gas lift valve assembly.

8. The system of claim 7, wherein the valve of the first gas lift valve assembly changes from a first position of the plurality of positions to a second position of the plurality of positions in response to the first power signal.

9. The system of claim 7, wherein the power further comprises a second power signal having a first frequency that is recognized by the first gas lift valve assembly and the second gas lift valve assembly.

10. The system of claim 1, wherein the control medium has a first density that is less than a second density of a subterranean resource disposed within the cavity proximate to the at least one gas lift valve.

11. A gas lift valve assembly comprising:

a body comprising at least one wall that forms a cavity;

an inlet channel disposed within the body, wherein the inlet channel comprises a top portion and a bottom portion, wherein the top portion is exposed to a first environment outside the cavity;

an outlet channel disposed adjacent to the inlet channel;

a fully electrically-operated valve disposed within the inlet channel and the outlet channel, wherein the fully electrically-operated valve has a plurality of positions within the inlet channel;

a controller disposed within the fully electrically-operated valve, wherein the controller is configured to receive at least one power signal from a power source, wherein the at least one power signal is transmitted through the body, and wherein the controller adjusts the fully electrically-operated valve to one of the plurality of positions based on the at least one power signal; and a toroidal core transformer disposed around the body adjacent to the valve, wherein the toroidal core transformer creates at least one controller signal from the at least one power signal, wherein the at least one controller signal is received by the controller to adjust the valve, wherein the controller recognizes a first plurality of frequencies of the at least one controller signal and ignores a second plurality of frequencies of the at least one controller signal, wherein the second plurality of frequencies are exclusive of the first plurality of frequencies.

12. The gas lift valve assembly of claim 11, wherein the at least one wall further comprises a top end and a bottom end, wherein the top end has a first coupling feature that is configured to couple to a first complementary coupling feature disposed on a first tubing pipe, wherein the first tubing pipe is disposed at a distal end of a first tubing string segment.

13. The gas lift valve assembly of claim 12, wherein the bottom end has a second coupling feature that is configured to couple to a second complementary coupling feature disposed on a second tubing pipe, wherein the second tubing pipe is disposed at a proximal end of a second tubing string segment.

14. A method for extracting a subterranean resource from within a wellbore, the method comprising:

delivering, using a delivery system, a first power signal to at least one gas lift valve assembly positioned in the wellbore, wherein the at least one gas lift valve assembly is mechanically coupled in series with a tubing string, wherein the tubing string is disposed above the at least one gas lift valve assembly, wherein the first power signal adjusts at least one valve of the at least one gas lift valve assembly to a first position, wherein the delivery system comprises the tubing string, wherein the tubing string comprises a plurality of electrically conductive tubing pipes mechanically coupled end-to-end and through which the first power signal flows to the at least one valve, wherein the first position of the at least one valve allows a first amount of a control medium to flow from outside the tubing string and the at least one gas lift valve assembly to within a cavity formed by the tubing string and the at least one gas lift valve assembly, wherein the subterranean resource is disposed within the cavity, wherein the first amount of control medium causes a second amount of the subterranean resource to reach a surface through the cavity; and delivering, using the delivery system, a second power signal to the at least one gas lift valve assembly, wherein the second power signal adjusts the at least one valve to a second position, wherein the second position of the at least one valve allows a third amount of a control medium to flow from outside the tubing string and the at least one gas lift valve assembly to within the cavity, wherein the third amount of control medium causes a fourth amount of the subterranean resource to reach the surface through the cavity, wherein the delivery system further comprises:

a casing disposed within the wellbore and comprising a plurality of electrically conductive casing pipes mechanically coupled end-to-end, wherein the casing has a second cavity running therethrough;

a first isolator sub mechanically coupled to and positioned between a top neutral section and a power-transmitting section of the tubing string, wherein the first isolator sub has the cavity running therethrough, and wherein the first isolator sub electrically separates the casing from the tubing string and the top neutral section from the power-transmitting section;

a second isolator sub mechanically coupled to the tubing string and positioned between a bottom neutral section and the power-transmitting section of the tubing string, wherein the second isolator sub has the cavity running therethrough, and wherein the second isolator sub electrically separates the bottom neutral section from the power-transmitting section; and a conductive interface disposed between the tubing string and the casing, wherein the conductive interface electrically couples the casing and the tubing string, wherein the at least one gas lift valve assembly is disposed below the first isolator sub and is electrically and mechanically coupled to the power-transmitting section of the tubing string, wherein the tubing string and the first isolator sub are disposed within a second cavity formed by the casing without contacting the casing, wherein the top neutral section of the tubing string is positioned proximate to an entry point of the wellbore, and wherein the bottom neutral section of the tubing string is positioned toward a distal end of the wellbore, wherein the power-transmitting section of the tubing string is positioned between the top neutral section and the bottom neutral section.

15. The method of claim 14, wherein the at least one gas lift valve assembly comprises a first gas lift valve assembly and a second gas lift valve assembly, wherein the first power signal is received by the first gas lift valve assembly and ignored by the second gas lift valve assembly, and wherein the second power signal is ignored by the first gas lift valve assembly and received by the second gas lift valve assembly.

16. A gas lift valve assembly comprising:

a body comprising at least one wall that forms a cavity;

an inlet channel disposed within the body, wherein the inlet channel comprises a top portion and a bottom portion, wherein the top portion is exposed to a first environment outside the cavity;

an outlet channel disposed adjacent to the inlet channel;

a valve disposed within the inlet channel and the outlet channel, wherein the valve has a plurality of positions within the inlet channel;

a controller disposed within the valve, wherein the controller is configured to receive a first power signal from a power source, wherein the first power signal is transmitted through the body and has a first frequency, wherein the first frequency is within a first range of frequencies, and wherein the controller adjusts the valve to one of the plurality of positions based on the first power signal, wherein the controller ignores a second power signal having a second frequency, wherein the second frequency is outside the first range of frequencies and within a second range of frequencies.

17. The gas lift valve assembly of claim 16, wherein the second power signal is received by an additional controller, wherein the additional adjusts an additional valve of an additional gas lift valve assembly using the second power signal, wherein the additional controller ignores the first power signal.

* * * * *